US009227762B2

(12) United States Patent
Sasaki et al.

(10) Patent No.: US 9,227,762 B2
(45) Date of Patent: Jan. 5, 2016

(54) BOTTLE CONTAINER WITH HANDLE

(71) Applicants: Masaaki Sasaki, Tokyo (JP); Yoshiyuki Kakuta, Tokyo (JP); Takao Iizuka, Tokyo (JP)

(72) Inventors: Masaaki Sasaki, Tokyo (JP); Yoshiyuki Kakuta, Tokyo (JP); Takao Iizuka, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 14 days.

(21) Appl. No.: 14/229,586

(22) Filed: Mar. 28, 2014

(65) Prior Publication Data

US 2014/0209560 A1 Jul. 31, 2014

Related U.S. Application Data

(62) Division of application No. 12/309,926, filed as application No. PCT/JP2007/066137 on Aug. 20, 2007, now Pat. No. 8,714,386.

(30) Foreign Application Priority Data

| | | |
|---|---|---|
| Aug. 30, 2006 | (JP) | 2006-234009 |
| Nov. 28, 2006 | (JP) | 2006-319799 |
| Apr. 27, 2007 | (JP) | 2007-119407 |
| Apr. 27, 2007 | (JP) | 2007-120239 |

(51) Int. Cl.

| | |
|---|---|
| ***B65D 23/10*** | (2006.01) |
| ***B65D 1/02*** | (2006.01) |
| ***B65D 1/40*** | (2006.01) |

(52) U.S. Cl.

CPC ..... *B65D 23/106* (2013.01); *B65D 1/0223* (2013.01); *B65D 1/40* (2013.01); *B65D 23/10* (2013.01); *Y10T 16/4707* (2015.01)

(58) Field of Classification Search

CPC ..... B65D 23/106; B65D 23/104; A47G 23/0241; B29L 2031/463; A61J 9/06

USPC ..... 215/396, 386, 395, 398; 220/759, 770; 425/525; D9/434

See application file for complete search history.

(56) References Cited

U.S. PATENT DOCUMENTS 3,137,423 A * 6/1964 Tupper ..... A47J 45/00 215/397
3,438,480 A * 4/1969 Chabrelot ..... A45C 7/0045 206/8

(Continued)

FOREIGN PATENT DOCUMENTS

GB 2 268 922 A 1/1994
JP U-56-162305 12/1981

(Continued)

OTHER PUBLICATIONS

Jul. 11, 2014 Office Action issued in U.S. Appl. No. 14/229,589.

(Continued)

*Primary Examiner* — Fenn Mathew
*Assistant Examiner* — Cynthia Collado
(74) *Attorney, Agent, or Firm* — Oliff PLC

(57) ABSTRACT

The invention relates to a bottle container with a handle. A mounting projecting portion projects from the bottle body, and the handle member has a handle portion connected to a mounting hole that allows the mounting projecting portion to be inserted thereinto. The handle member is mounted on the bottle body by inserting the mounting projecting portion into the mounting hole, and then rotating the mounting projecting portion around a central axis of the mounting projecting portion relative to the bottle body. The inner peripheral surface of the mounting hole has an abutting portion that abuts with an engaging recessed groove in the outer surface of the mounting projecting portion. The mounting portion has a guide portion that slides on a sliding surface of the outer surface of the mounting projecting portion with the relative rotation of the handle member and the bottle body, and guides the relative rotation.

6 Claims, 20 Drawing Sheets

(56) References Cited

U.S. PATENT DOCUMENTS

| | | | | | |
|---|---|---|---|---|---|
| 4,643,326 | A | | 2/1987 | Klingler | |
| 4,842,158 | A | | 6/1989 | Reyes, Jr. | |
| 4,915,241 | A | | 4/1990 | Morimura et al. | |
| 4,964,522 | A | * | 10/1990 | Umetsu | B29C 49/20 215/383 |
| 5,092,476 | A | * | 3/1992 | Yasuda | B65D 23/106 215/398 |
| 5,167,970 | A | * | 12/1992 | Yoshino | B29C 31/008 215/398 |
| 5,535,901 | A | * | 7/1996 | Ishii | B65D 23/106 215/396 |
| 5,704,506 | A | | 1/1998 | Tobias et al. | |
| 5,931,324 | A | * | 8/1999 | Lyons | B29C 65/08 156/580.1 |
| 6,012,597 | A | * | 1/2000 | Nishihara | B65D 23/106 215/398 |
| 7,108,146 | B2 | * | 9/2006 | Itokawa | B65D 23/106 215/386 |
| 7,481,326 | B2 | * | 1/2009 | Itokawa | B29C 49/20 215/396 |
| 7,600,655 | B2 | | 10/2009 | Agrawal et al. | |
| 8,261,932 | B2 | | 9/2012 | Miura | |
| 8,714,386 | B2 | | 5/2014 | Sasaki et al. | |
| 2007/0262047 | A1 | * | 11/2007 | Agrawal | B29C 49/20 215/398 |
| 2010/0187246 | A1 | * | 7/2010 | Miura | B29C 49/20 220/771 |

FOREIGN PATENT DOCUMENTS

| | | | |
|---|---|---|---|
| JP | U-61-160309 | | 10/1986 |
| JP | Y2-2-3216 | | 1/1990 |
| JP | Y2-3-44601 | | 9/1991 |
| JP | U-4-45227 | | 4/1992 |
| JP | Y2-4-33241 | | 8/1992 |
| JP | A-08-282671 | | 10/1996 |
| JP | A-10-045135 | | 2/1998 |
| JP | A-2000-255580 | | 9/2000 |
| JP | B2-3200619 | | 8/2001 |
| WO | WO 2007/131244 | A1 | 11/2007 |

OTHER PUBLICATIONS

Extended European Search Report issued in European Application No. 07792750.7 dated Mar. 15, 2011.

Jan. 17, 2012 Office Action issued in Japanese Patent Application No. 2006-319799 (with translation).

U.S. Appl. No. 12/309,926, filed Feb. 3, 2009 in the name of Sasaki et al.

Oct. 23, 2013 Quayle Action issued in U.S. Appl. No. 12/309,926.

May 29, 2013 Final Rejection issued in U.S. Appl. No. 12/309,926.

Oct. 26, 2012 Rejection issued in U.S. Appl. No. 12/309,926.

Sep. 13, 2012 Restriction/Election issued in U.S. Appl. No. 12/309,926.

* cited by examiner

BOTTLE CONTAINER WITH HANDLE

This is a Division of application Ser. No. 12/309,926 filed Feb. 3, 2009, which in turn is a National Phase of PCT/JP2007/066137 filed Aug. 20, 2007. The disclosures of the prior applications are hereby incorporated by reference herein in their entirety.

TECHNICAL FIELD

The present invention relates to a bottle container with a handle which is constructed such that a handle member is mounted on a bottle body.

Priority is claimed on Japanese Patent Application No. 2006-234009, filed Aug. 30, 2006, Japanese Patent Application No. 2006-319799, filed Nov. 28, 2006, Japanese Patent Application No. 2007-119407, filed Apr. 27, 2007, and Japanese Patent Application No. 2007-120239, filed Apr. 27, 2007, the contents of which are incorporated herein by reference.

BACKGROUND ART

Conventionally, as the aforementioned bottle container with a handle, one having a bottle body formed with a cylindrical mounting projecting portion, and a handle member provided with a locking port which is engageable with the mounting projecting portion is suggested as disclosed in, for example, Patent Document 1. This bottle container with a handle is constructed such that the mounting projecting portion is provided with a plurality of locking pieces which project radially outward, the mounting projecting portion is inserted into the locking port to rotate the bottle body and the handle member relative to each other, and the locking port is engaged with the locking pieces to fix the bottle body and the handle member to each other.

Additionally, a bottle container in which a handle member is made up of a main member provided with a handle portion, and an auxiliary member joined to the main member, and a bottle body is fixed to the handle member by sandwiching a mounting projecting portion, which is provided so as to project from the bottle container, between the main member and the auxiliary member, is suggested in Patent Document 2.

Patent Document 1: Japanese Unexamined Utility Model Application, Second Publication No. H4-33241

Patent Document 2: Japanese Unexamined Patent Application, First Publication No. H8-282671

DISCLOSURE OF THE INVENTION

Problems that the Invention is to Solve

However, in the bottle container with a handle described in Patent Document 1, the mounting projecting portion which projects from the bottle body is formed in a cylindrical shape. Thus, when the handle is gripped and handled, there is a possibility that the handle member may rotate and come off from the bottle body. In a case where the handle member comes off from the bottle body, there is a problem in that the bottle body may fall, and the bottle container may be damaged or its contents may leak.

Additionally, in the conventional bottle container with a handle described in Patent Document 1, non-smoothness occurs in a radial direction of the mounting projecting portion when the handle member and the bottle body are rotated relative to each other. Accordingly, when the handle member and the bottle body are rotated relative to each other, the handle member and the bottle body may not be rotated smoothly, and it is difficult for the handle member to be mounted on the bottle body. Additionally, since the handle member looses in the radial direction of the mounting projecting portion even after the handle member has been mounted on the bottle body, it is difficult to use the bottle container.

Additionally, in the bottle container with a handle described in Patent Document 2, the handle member is fixed by sandwiching the mounting projecting portion between the main member and the auxiliary member. Thus, when an impact is applied to the handle member, and fitting of the main member to the auxiliary member is released, the bottle body and the handle member will also be disengaged from each other.

Additionally, it takes time to mount the handle member. Moreover, since the handle member is made up of two members, the structure of the container becomes complicated. For these reasons, the manufacturing cost of the bottle container with a handle may increase.

The invention was made in view of the above circumstances, and has an object of providing a bottle container with a handle capable of firmly fixing a bottle body and a handle member to each other.

Additionally, the invention has an object of providing a bottle container with a handle capable of smoothly rotating the handle member and the bottle body relative to each other when the handle member is mounted on the bottle body, and capable of suppressing looseness of the handle member after mounting.

Additionally, the invention has an object of providing a bottle container with a handle with a simple structure.

Means for Solving the Problems

In order to solve the above problems, a bottle container with a handle of a first aspect of the invention is a bottle container with a handle which include a bottle body and a handle member mounted on the bottle body. A mounting projecting portion which forms a polygonal cross-sectional shape is provided so as to project from the bottle body, and the handle member is provided with a mounting hole which forms a substantially rectangular cross-sectional shape and which allows the mounting projecting portion to be inserted thereinto. An outer peripheral edge of the polygon formed by the cross-section of the mounting projecting portion is provided with a pair of lateral pressure-contacting portions which extend along a central axis of the bottle body, and a pair of axial pressure-contacting portions which extend in a direction orthogonal to the central axis. The handle member is mounted on the bottle body in a state where four side portions of the mounting hole are brought into pressure contact with the pair of lateral pressure-contacting portions and the pair of axial pressure-contacting portions, respectively, by inserting the mounting projecting portion into the mounting hole, and then rotating the bottle body and the handle member relative to each other.

According to the bottle container with a handle of the first aspect, the mounting projecting portion forms a polygonal cross-sectional shape, and an outer peripheral edge of the polygon is provided with a pair of lateral pressure-contacting portions which extend along a central axis of the bottle body and a pair of axial pressure-contacting portions which extend in a direction orthogonal to the central axis. Accordingly, since the handle member is brought into pressure contact and fixed by four pressure-contacting portions arranged at intervals of 90°, there is no possibility that the mounting projecting portion and the mounting hole may be readily rotated relatively to each other. Additionally, the mounting projecting portion and the mounting hole are brought into pressure contact with each other by these four pressure-contacting portions, and the bottle body and the handle member are firmly fixed to each other. Moreover, even if a load is applied axially when the handle portion is gripped and lifted, the axial position of the handle member is firmly fixed by the axial pressure-contacting portions, thereby preventing the handle member from coming off from the bottle body.

Accordingly, even when the handle portion is gripped and handled, the bottle body and the handle member can be prevented from being disengaged from each other.

Additionally, the handle member may be formed with a locking portion which projects toward an inner peripheral side of the mounting hole, and the mounting projecting portion may be formed with an engaging recessed groove portion which is engaged with the locking portion.

In this case, since the mounting projecting portion and the mounting hole are brought into pressure contact with each other, and the locking portion and the engaging recessed groove portion are engaged with each other, it is possible to further improve the mounting strength between the handle member and the bottle body, thereby firmly fixing them.

A bottle container with a handle of a second aspect of the invention is a bottle container with a handle which include a bottle body provided with a mounting projecting portion so as to project therefrom and a handle member mounted on the mounting projecting portion. The handle member has a mounting portion provided with a mounting hole which allows the mounting projecting portion to be inserted thereinto, and a handle portion which extends from the mounting portion, and is mounted on the bottle body by inserting the mounting projecting portion into the mounting hole, and then rotating the mounting projecting portion relative to the bottle body. The bottle body is provided with a rotation preventing member which accommodates the handle portion to prevent the relative rotation of the bottle body and the handle member in a state where the handle member has been mounted.

In the bottle container with a handle of the second aspect, the bottle body is provided with a rotation preventing member which prevents the relative rotation of the bottle body and the handle member in a state where the handle member has been mounted. Accordingly, even if the handle member is constructed so as to be mounted on the bottle body by inserting the mounting projecting portion into the mounting hole, and then rotating the handle member relative to the bottle body, the bottle body and the handle member can be prevented from being disengaged from each other.

Accordingly, when the handle member is gripped, the problem of the bottle body falling, and the bottle container becoming damaged or its contents leaking can be prevented beforehand.

Here, the handle portion may be provided so as to extend from upper and lower ends, of the mounting portion, in a state where the handle member is mounted on the bottle body, and a locking recessed portion capable of locking the handle portion, which serves as the rotation preventing member, may be provided on at least one side of the mounting projecting portion of the bottle body in an up-down direction.

In this case, the relative rotation of the bottle body and the handle member can be reliably prevented by locking the handle portion extending from the upper and lower ends, of the mounting projecting portion to the locking recessed portion provided on at least one side of the mounting projecting portion of the bottle body in the up-down direction.

Additionally, the mounting hole may form a substantially circular cross-sectional shape, and the mounting projecting portion may be provided with an elastically deformable portion which is elastically deformed by an inner wall surface of the mounting hole when the handle member has been mounted.

In this case, since the mounting hole has a substantially circular cross-sectional shape, the mounting hole is readily rotated relative to the mounting projecting portion. However, since the rotation preventing member is provided, the handle member can be mounted reliably. Consequently, since the handle member with a simple shape in which the cross-section of the mounting hole is formed in a substantially circular shape can be applied, the handle member can be manufactured at low cost. Additionally, since the mounting projecting portion is provided with the elastically deformable portion which is elastically deformed by the inner wall surface of the mounting hole, the mounting projecting portion and the mounting hole can be brought into pressure contact with each other to firmly mount the handle member, and the relative rotation of the handle member and the bottle body can be prevented more reliably.

A bottle container with a handle of a third aspect of the invention is a bottle container with a handle which includes a bottle body provided with a mounting projecting portion so as to project therefrom and a handle member mounted on the mounting projecting portion. The handle member has a mounting portion formed with a mounting hole which allows the mounting projecting portion to be inserted thereinto, and a handle portion connected to the mounting portion, and is mounted on the bottle body by inserting the mounting projecting portion into the mounting hole, and then rotating the mounting projecting portion relative to the bottle body. An outer peripheral surface of the mounting projecting portion is formed with an engaging recessed groove which extends in a peripheral direction of the mounting projecting portion. The inner peripheral surface of the mounting hole is provided with an abutting portion which abuts on at least one of a bottom surface of the engaging recessed groove and the outer peripheral surface of the mounting projecting portion and a retaining portion which is accommodated inside the engaging recessed groove, in a state where the handle member has been mounted on the mounting projecting portion. The retaining portion includes a proximal end portion connected to an inner surface of the mounting hole, and a distal end portion provided at a tip of the proximal end portion, and is formed so as to be elastically deformable, and when the handle member has been mounted on the bottle body, at least a portion of the distal portion is housed inside the engaging recessed groove.

In the third aspect, when the handle member is mounted on the bottle body, first, the mounting projecting portion is inserted into the mounting hole. In this case, since the retaining portion is formed so as to be elastically deformable, the mounting projecting portion is smoothly inserted into the mounting hole. Next, the handle member and the bottle body are rotated relative to each other, thereby allowing the retaining portion to be housed inside the engaging recessed groove of the mounting projecting portion. Accordingly, even if an external force (a force which pulls out the mounting projecting portion from the mounting hole) which is directed radially outward of the bottle acts on the handle member, the retaining portion is caught by the inner surface of the engaging recessed groove. Therefore, the handle member can be prevented from coming off from the bottle body. Additionally, at this time, the abutting portion abuts on at least one of the bottom surface of the engaging recessed groove and the outer peripheral surface of the mounting projecting portion. Thus, relative rotation of the handle member and the bottle body after the handle member is mounted is prevented.

Additionally, in the bottle container with a handle according to the third aspect, preferably, the abutting portion may be disposed so as to sandwich the bottom surface of the engaging recessed groove from both sides in a direction of a bottle axis in a state where the handle member has been mounted on the mounting projecting portion, and the retaining portion may be disposed so as to sandwich the mounting projecting portion from both sides in a direction orthogonal to the bottle axis.

Thereby, the bottom surface of the engaging recessed groove is sandwiched from both sides in the direction of the bottle axis by the abutting portion. Thus, when the handle portion is gripped and lifted, the weight of the bottle body is firmly supported by the abutting portion.

Additionally, in the bottle container with a handle according to the third aspect, preferably, the retaining portion abuts on the bottom surface of the engaging recessed groove in a state where the handle member has been mounted on the mounting projecting portion.

Thereby, the retaining portion also serves as a rotation stopper similarly to the abutting portion. Thus, relative rotation of the handle member and the bottle body after the handle member is mounted is further prevented.

A bottle container with a handle according to a fourth aspect of the invention is a bottle container with a handle which includes a bottle body provided with a mounting projecting portion so as to project therefrom and a handle member mounted on the mounting projecting portion. The handle member has a mounting portion formed with a mounting hole which allows the mounting projecting portion to be inserted thereinto, and a handle portion connected to the mounting portion, and is mounted on the bottle body by inserting the mounting projecting portion into the mounting hole, and then rotating the mounting projecting portion around a central axis of the mounting projecting portion relative to the bottle body. An outer peripheral surface of the mounting projecting portion is formed with an engaging recessed groove which extends in a peripheral direction of the mounting projecting portion, and a sliding surface which extends along a circumference having a central axis of the mounting projecting portion as a center. The inner peripheral surface of the mounting hole is provided with an abutting portion which is accommodated inside the engaging recessed groove, and abuts on a bottom surface of the engaging recessed groove. The mounting portion is provided with a guide portion which slides on the sliding surface with the relative rotation of the handle member and the bottle body, and guides the relative rotation.

In the fourth aspect, when the handle member is mounted on the bottle body, first, the mounting projecting portion is inserted into the mounting hole while alignment between the mounting portion and the mounting projecting portion is performed by the guide portion. Next, the handle member and the bottle body are rotated relative to each other. At this time, since the guide portion slides on the sliding surface of the mounting projecting portion, and the relative rotation of the bottle body and the handle member is guided, radial non-smoothness of the mounting projecting portion is suppressed. Additionally, with the above relative rotation, the abutting portion is accommodated inside the engaging recessed groove, and the abutting portion abuts on the bottom surface of the engaging recessed groove in a predetermined position. Thereby, in a state where the handle member is mounted on the bottle body, radial looseness of the mounting projecting portion is suppressed, and the relative rotation of the handle member and the bottle body is prevented. Additionally, even if an external force (a force which pulls out the mounting projecting portion from the mounting hole) which is directed radially outward of the bottle acts on the handle member, the abutting portion serves as a retainer, and is caught by the inner surface of the engaging recessed groove. Therefore, the handle member is prevented from coming off from the bottle body.

Additionally, in the bottle container with a handle according to the fourth aspect, preferably, the abutting portion is disposed so as to sandwich the bottom surface of the engaging recessed groove from both sides in the direction of a bottle axis in a state where the handle member has been mounted on the mounting projecting portion.

Thereby, the bottom surface of the engaging recessed groove is sandwiched from both sides in the direction of the bottle axis by the abutting portion. Thus, when the handle portion is gripped and lifted, the bottle body is firmly supported by the abutting portion.

Additionally, in the bottle container with a handle according to the fourth aspect, preferably, the guide portion has a circular-arc surface which extends along the sliding surface, and is disposed so as to sandwich the mounting projecting portion in its radial direction.

Thereby, the relative rotation of the bottle body and the handle member is reliably guided by the guide portion. Additionally, since the guide portion is arranged so as to sandwich the mounting projecting portion in its radial direction in a state where the handle member has been mounted on the mounting projecting portion, looseness of the handle member after mounting is further suppressed.

Additionally, in the bottle container with a handle according to the fourth invention, a proximal end portion of the mounting projecting portion may become a circular pedestal portion whose outer peripheral surface is formed as the sliding surface, and the guide portion may have a fitting hole into which the circular pedestal portion is slidably fitted.

Accordingly, since the bottle body and the handle member are guided over the entire periphery when they are rotated relative to each other, the relative rotation is guided more reliably. Additionally, since the guide portion is arranged so as to surround the circular pedestal portion, looseness of the handle member after mounting is further suppressed.

Additionally, in the bottle container with a handle according to the fourth aspect, preferably, the abutting portion is formed with a recessed portion which is recessed radially outward of the mounting hole, and the bottom surface of the engaging recessed groove is formed with a projecting portion which projects radially outward of the mounting projecting portion, and is engaged with the recessed portion when the handle member has been mounted on the mounting projecting portion.

Thereby, when the bottle body and the handle member are rotated relative to each other to a position where the projecting portion and the recessed portion are engaged with each other, the relative rotation is regulated. That is, the termination position of the above relative rotation is determined by the projecting portion and the recessed portion. Additionally, since the projecting portion and the recessed portion are engaged with each other when the handle member is mounted on the bottle body, the relative rotation of the handle member and the bottle body after the handle member has been mounted is prevented more reliably.

Additionally, in the bottle container with a handle according to the fourth aspect, the abutting portion may be formed with an abutting surface which forms a chord on the inner peripheral surface of the mounting hole seen from a side surface of the bottle, and the bottom surface of the engaging recessed groove may be formed with a planar abutted surface on which the abutting surface abuts when the handle member is mounted on the mounting projecting portion.

Thereby, since the contact area between the abutting portion and the bottom surface of the engaging recessed groove becomes large, looseness of the handle member after mounting is further suppressed.

Advantages of the Invention

According to the first aspect, the shape of the mounting projecting portion of the bottle body and the shape of the mounting hole of the handle member can be made simple, and the bottle body and the handle member are reliably fixed to each other.

According to the second aspect, the bottle body and the handle member can be reliably fixed to each other by preventing the relative rotation of the bottle body and the handle member.

According to the third aspect, since the mounting projecting portion does not come off from the mounting hole by the retaining portion, and the relative rotation of the handle member and the bottle body is prevented by the abutting portion, the mounted handle member can be prevented from being disengaged from the bottle body.

According to the fourth aspect, since non-smoothness when the bottle body and the handle member are rotated relatively to each other is suppressed, the bottle body and the handle member can be smoothly rotated relative to each other when the handle member is mounted on the bottle body, and the mounting becomes easy. Additionally, the relative rotation of the bottle body and the handle member after mounting can be prevented, radial looseness of the mounting projecting portion after mounting can be suppressed, and the bottle body and the handle member can be reliably fixed to each other.

REFERENCE NUMERALS

Figure 1:
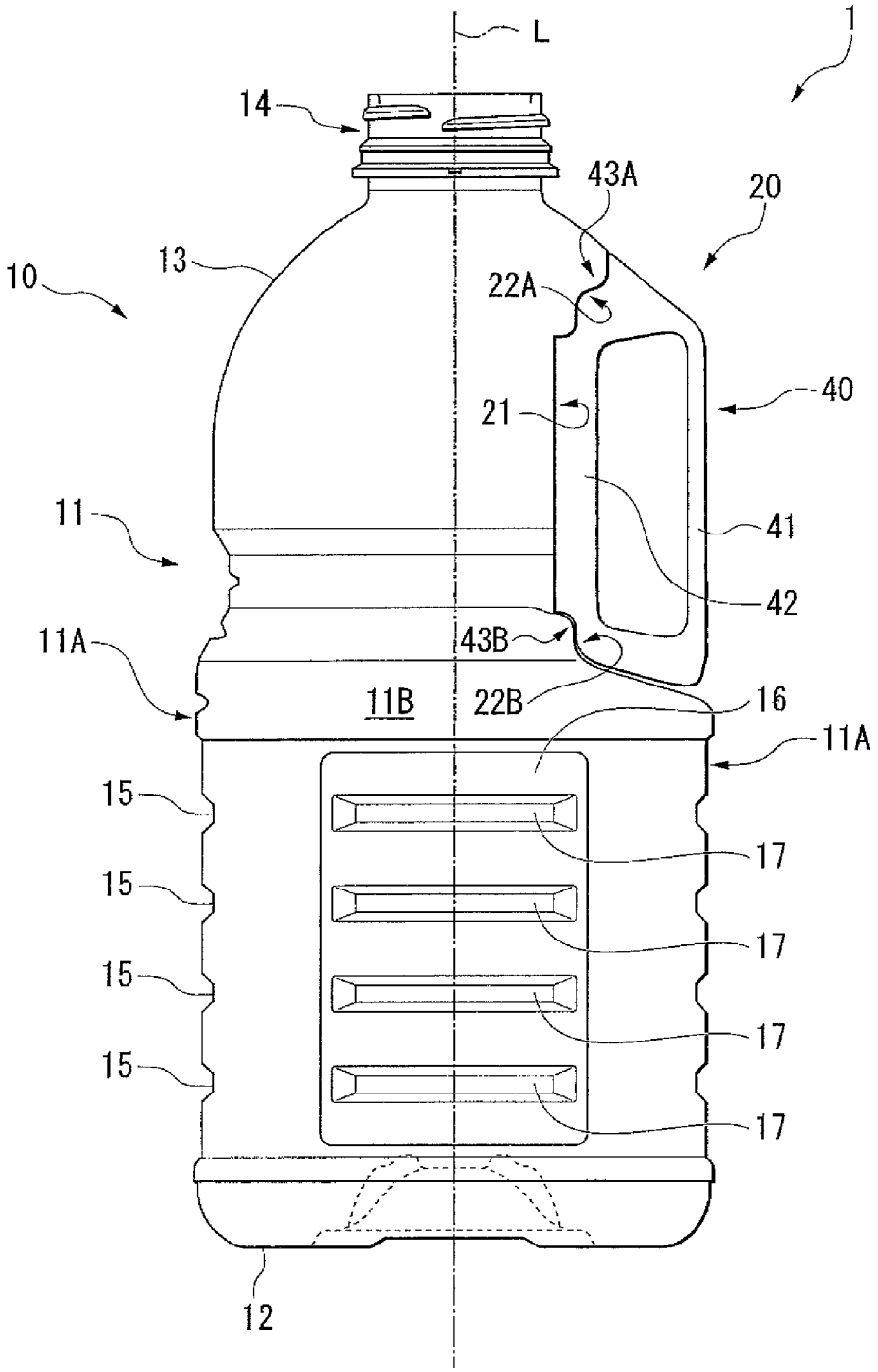
FIG. 1 is a side view of a bottle container with a handle which is a first embodiment of the invention.

1, 100, 200, 300, 400, 500: BOTTLE CONTAINER WITH HANDLE
10, 110: BOTTLE BODY
30, 130, 230, 330, 430, 530: MOUNTING PROJECTING PORTION
31, 231: LATERAL PRESSURE-CONTACTING PORTION
32, 232: AXIAL PRESSURE-CONTACTING PORTION
34, 133, 234, 333, 433, 533: ENGAGING RECESSED GROOVE
40, 140, 240, 340, 440, 540: HANDLE MEMBER
41, 141, 241, 341, 441, 541: MOUNTING PORTION
42, 142, 242, 342, 442, 542: HANDLE PORTION
44, 144, 244, 344, 444, 544: MOUNTING HOLE
45, 245: ANNULAR LOCKING PORTION (LOCKING PORTION)
124: LOCKING RECESSED PORTION (ROTATION PREVENTING MEMBER)
134: ELASTICALLY DEFORMABLE PORTION
345, 445, 545: ABUTTING PORTION
346: RETAINING PORTION
346*a*: PROXIMAL END PORTION
346*b*: DISTAL END PORTION
447, 547: GUIDE PORTION

BEST MODE FOR CARRYING OUT THE INVENTION

Hereinafter, embodiments of the invention will be described with reference to the accompanying drawings.

First Embodiment

A first embodiment of the invention will be described with reference to FIGS. 1 to 7. A bottle container with a handle which is a first embodiment is shown in FIGS. 1 to 5.

A bottle axis L represents the central axis of the bottle container 1 with a handle. The side (the upper side in FIG. 3) of a mouth portion 14 in the direction of the bottle axis L is defined as the upside, the side (the lower side in FIG. 3) of a bottom portion 12 in the direction of the bottle axis L is defined as the downside, and a direction (lateral direction in FIG. 3) orthogonal to the bottle axis L and along a vertical wall 21 to be described is defined as a right-left direction.

The bottle container 1 with a handle has a bottle body 10, and a handle member 40 to be mounted on the bottle body 10.

The bottle body 10 includes a substantially rectangular tubular trunk portion 11 which extends along the bottle axis L, the bottom portion 12 which is connected to a lower end of the trunk portion 11, a shoulder portion 13 which is connected to an upper end of the trunk portion 11 and constructed such that its cross-sectional area becomes gradually small toward the upside, and the mouth portion 14 which is connected to an upper end portion of the shoulder portion 13 and extends toward the upside. The trunk portion 11, the bottom portion 12, the shoulder portion 13, and the mouth portion 14 are integrally formed from, for example, synthetic resins, such as polyethylene terephthalate (PET), with the bottle axis L as a common axis.

Figure 3:
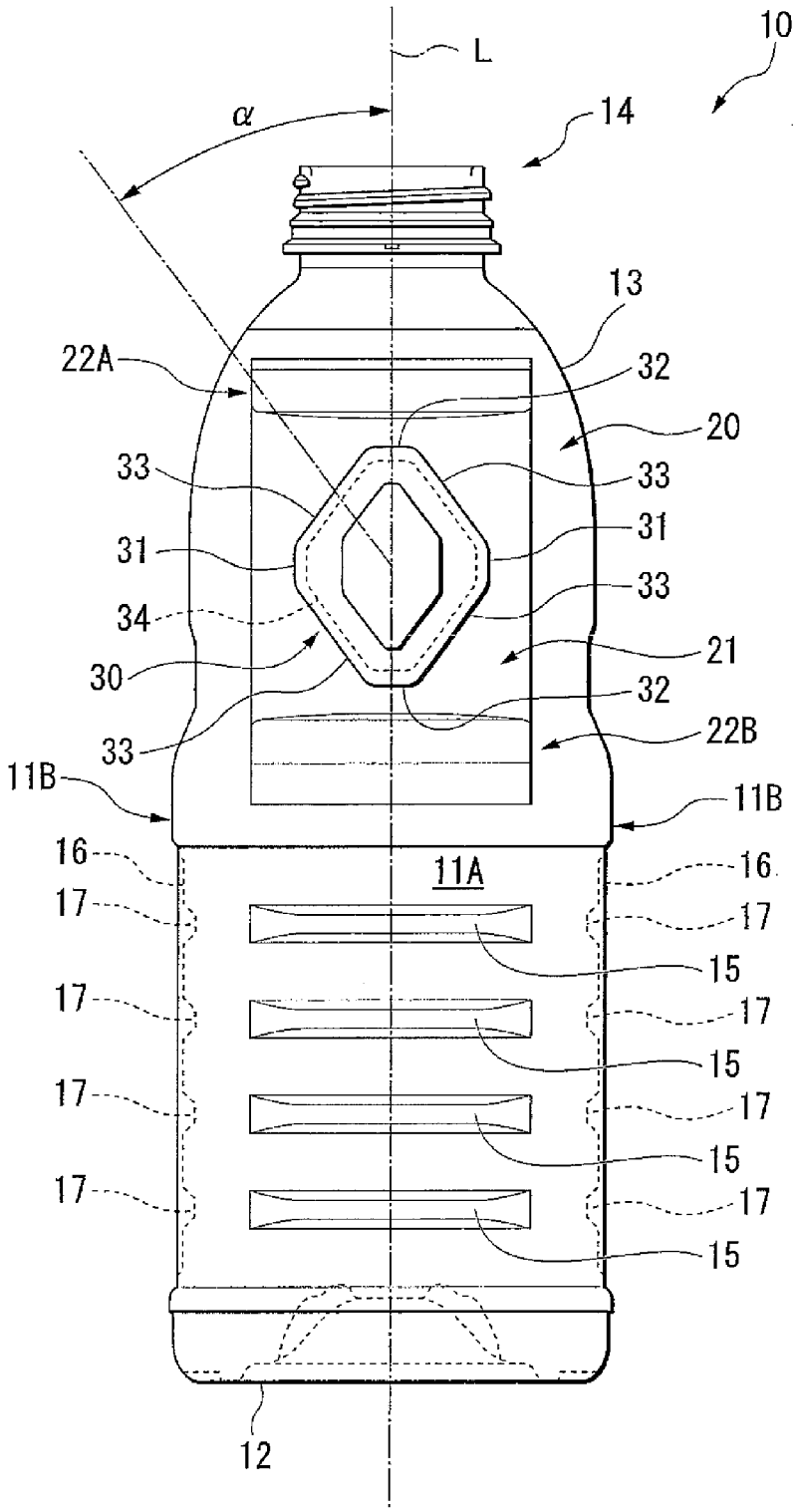
FIG. 3 is a front view when a mounting projecting portion of the bottle body shown in FIG. 2 is seen from the front.

The trunk portion 11 includes a pair of short side wall surfaces 11A and 11A and a pair of long side wall surfaces 11B and 11B. The short side wall surfaces 11A and 11A face each other with the bottle axis L therebetween, and the long side wall surfaces 11B and 11B face each other with the bottle axis L therebetween. A plurality of (four as shown in FIG. 3 in this embodiment) recessed grooves 15 which extend in a peripheral direction of the trunk portion 11 are formed at intervals in the direction of the bottle axis L in each of the pair of short side wall surfaces 11A and 11A.

Figure 2:
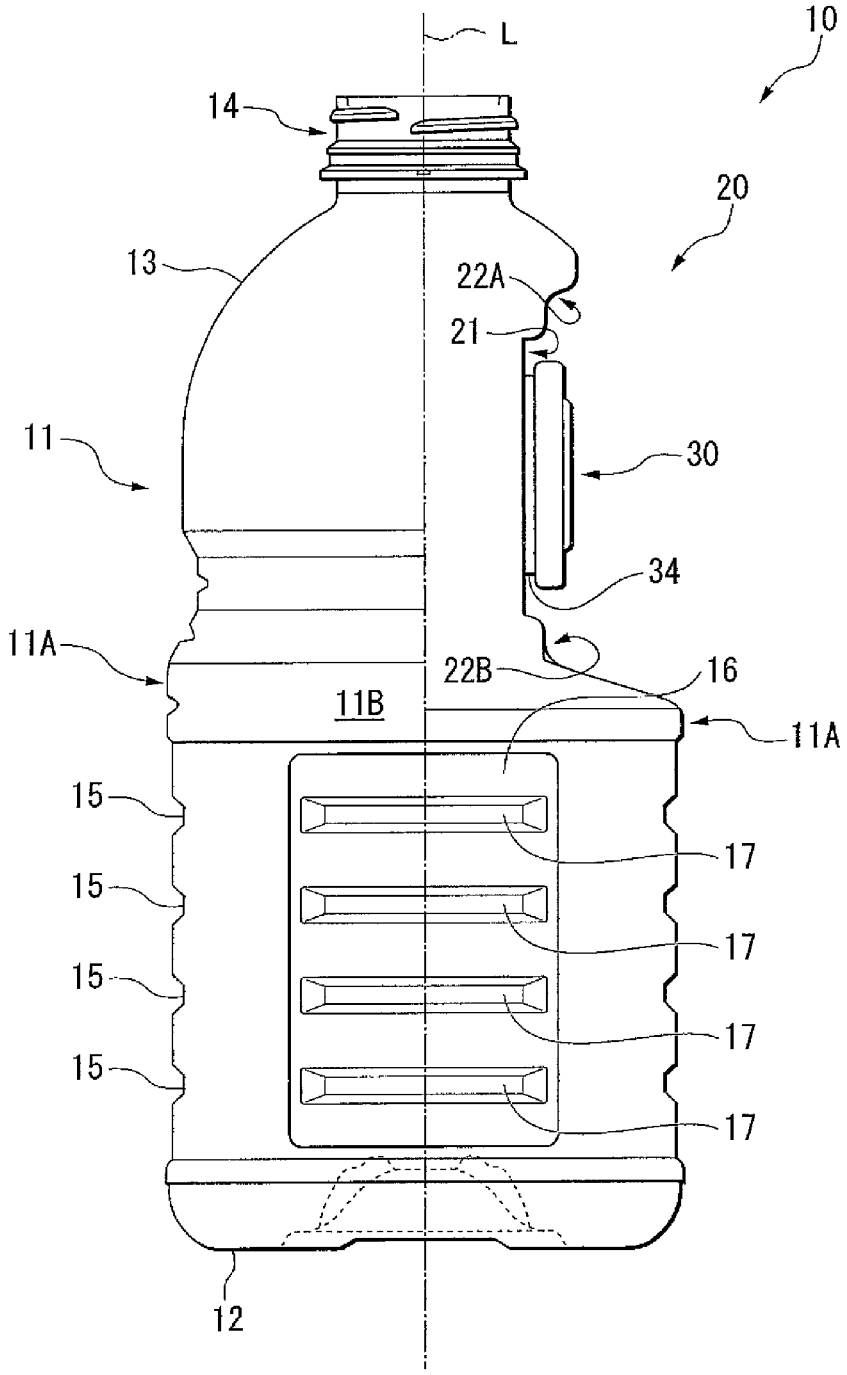
FIG. 2 is a side view of a bottle body which constitutes the bottle container with a handle shown in FIG. 1.

Additionally, each of the pair of long side wall surfaces 11B and 11B is provided with a pressure reducing/absorbing panel 16, and a plurality of (four as shown in FIG. 2 in this embodiment) recessed grooves 17 which extend in the peripheral direction of the trunk portion 11 are formed at intervals in the direction of the bottle axis L inside the pressure reducing/absorbing panel 16.

Here, in the trunk portion 11, a recessed portion 20 which is recessed toward the inside of the bottle body 10 is provided in a portion ranging from an upper portion of one (right one in FIG. 2) short side wall surface 11A to the shoulder portion 13. The recessed portion 20 has the vertical wall 21 which extends parallel to the bottle axis L, an upper end of the vertical wall 21 is formed with a stepped portion 22A connected to the shoulder portion 13, and a lower end thereof is formed with a stepped portion 22B connected to the trunk portion 11.

A mounting projecting portion 30 which forms an octagonal cross-sectional shape projects from the vertical wall 21.

The mounting projecting portion 30 includes a pair of lateral pressure-contacting portions 31 and 31 which extend along the bottle axis L, a pair of axial pressure-contacting portions 32 and 32 which extend in a direction orthogonal to the bottle axis L and along an external surface of the bottle body 10, and four oblique side portions 33 which connect the lateral pressure-contacting portions 31 and the axial pressure-contacting portions 32. A pair of facing oblique side portions 33 and 33 of the four oblique side portions 33 is arranged parallel to each other. Moreover, an angle $\alpha$ formed between the oblique side portion 33 and the bottle axis L is $\alpha$=38° in this embodiment.

Here, the distance between the lateral pressure-contacting portions 31 and 31 is set to be greater than the distance between the pair of oblique side portions 33 and 33. Additionally, the length of the lateral pressure-contacting portion 31 is set to be shorter than that of the oblique side portion 33 and to be longer than the axial pressure-contacting portion 32.

An engaging recessed groove 34 is formed in the mounting projecting portion 30 between the vertical wall 21 and the mounting projecting portion.

Figure 4:
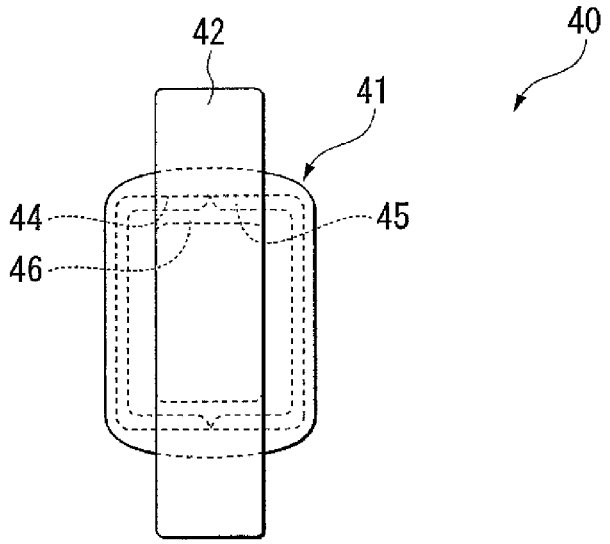
FIG. 4 is a front view of a handle member which constitutes the bottle container with a handle shown in FIG. 1.
Figure 5:
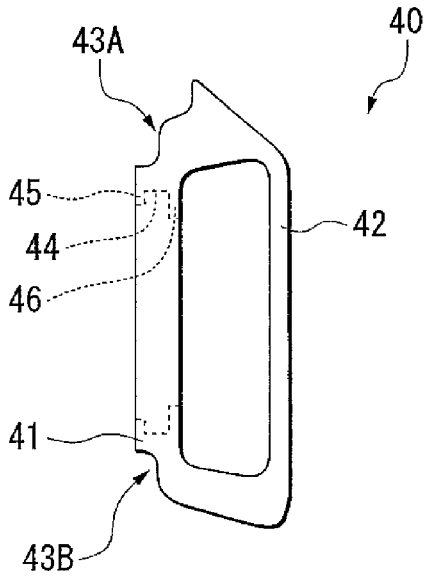
FIG. 5 is a side view of the handle member shown in FIG. 4.

Next, the handle member 40 will be described with reference to FIGS. 4 and 5. The handle member 40 includes a substantially rectangular flat-plate-shaped mounting portion 41, and a handle portion 42 which is erected from the surface of the mounting portion 41, and the mounting portion 41 and the handle portion 42 are molded integrally. Step portions 43A and 43B are formed at connection portions between the mounting portion 41 and the handle portion 42. The step portion 43A has a shape corresponding to the outer contour of the stepped portion 22A provided at upper end of the recessed portion 20, and the step portion 43B has a shape corresponding to the outer contour of the stepped portion 22B provided at lower end of the recessed portion 20

The mounting portion 41 is formed with a mounting hole 44 having a substantially rectangular cross-sectional shape. Here, the distance between long sides of the mounting hole 44 is set to be approximately equal to the distance between the lateral pressure-contacting portions 31 and 31 of the mounting projecting portion 30 and to be greater than the distance between the pair of facing oblique side portions 33 and 33 of the mounting projecting portion 30. Additionally, the distance between short sides of the mounting hole 44 is set to be approximately equal to the distance between the axial pressure-contacting portions 32 and 32 of the mounting projecting portion 30.

An annular locking portion 45 is formed on the rear surface of the mounting portion 41 so as to project toward the inner peripheral side of the mounting hole 44 from an inner peripheral edge of the mounting hole 44. The distance between long sides of the annular locking portion 45 is set to be approximately equal to the distance between the oblique side portions 33 and 33 of the mounting projecting portion 30. Additionally, the distance between short sides of the annular locking portion 45 is set to be smaller than the distance between the axial pressure-contacting portions 32 and 32 of the mounting projecting portion 30.

Additionally, an abutting wall portion 46 is formed on the front surface of the mounting portion 41 so as to project toward the inner peripheral side of the mounting hole 44 from the inner peripheral edge of the mounting hole 44.

A method of mounting this handle member 40 on the bottle body 10 will be described with reference to FIGS. 6 and 7.

Figure 6:
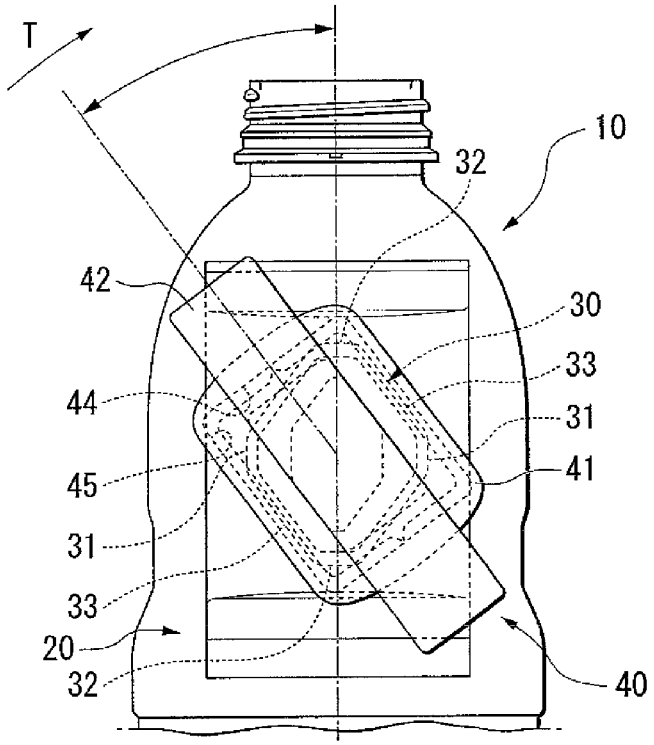
FIG. 6 is an explanatory view showing a state where the bottle body and the handle member are engaged with each other.
Figure 7:
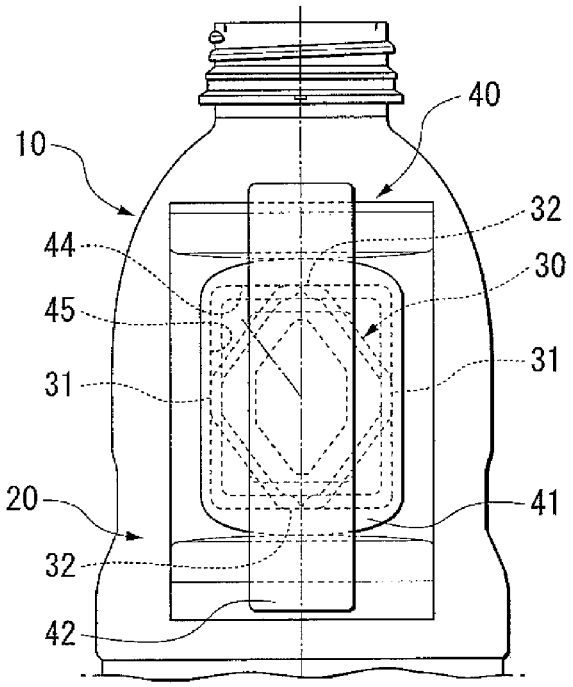
FIG. 7 is an explanatory view showing a state where the bottle body and the handle member are fixed to each other.

First, as shown in FIG. 6, an arrangement is made such that the handle member 40 is inclined at an angle $\alpha$ with respect to the bottle axis L of the bottle body 10, i.e., the long sides of the mounting hole 44 of the handle member 40 become parallel to the pair of oblique side portions 33 and 33 of the mounting projecting portion 30. Here, since the distance between the long sides of the annular locking portion 45 is set to be approximately equal to the distance between the pair of facing oblique side portions 33 and 33 of the mounting projecting portion 30 and the distance between the long sides of the mounting hole 44 is set to be greater than the distance between the pair of facing oblique side portions 33 and 33 of the mounting projecting portion 30, it is possible to insert the mounting projecting portion 30 into the mounting hole 44.

In this way, the mounting projecting portion 30 is inserted into the mounting hole 44, and the abutting wall portion 46 of the handle member 40 abuts on the mounting projecting portion 30.

In a state where the mounting projecting portion 30 has been inserted into the mounting hole 44 in this way, the handle member 40 is turned toward a rotational direction T, and is arranged such that the long sides of the mounting hole 44 become parallel to the bottle axis L of the bottle body 10. Then, a pair of short side portions of the mounting hole 44 are respectively brought into pressure contact with the axial pressure-contacting portions 32 and 32 of the mounting projecting portion 30, and a pair of long side portions of the mounting hole 44 are respectively brought into pressure contact with the lateral pressure-contacting portions 31 and 31 of the mounting projecting portion 30. Additionally, the annular locking portion 45 and the engaging recessed groove 34 of the mounting projecting portion 30 are engaged with each other. This allows the handle member 40 to be mounted on the bottle body 10.

In this way, the bottle container 1 with a handle, which is this embodiment, is constructed. In addition, in a state where the handle member 40 is mounted, as shown in FIG. 1, the handle member 40 is constructed so as to be located more inside than an outer peripheral portion of a lower portion of the trunk portion 11.

According to the bottle container 1 with a handle of this construction, the mounting projecting portion 30 forms an octagonal cross-sectional shape, and the mounting hole 44 forms a substantially rectangular cross-sectional shape. Thus, in a state where the mounting projecting portion 30 and the mounting hole 44 are brought into pressure contact with each other, they are kept from readily rotating relatively. Accordingly, when the handle portion 42 is gripped and handled, the bottle body 10 and the handle member 40 can be prevented from being unexpectedly disengaged from each other.

Additionally, since the mounting projecting portion 30 and the mounting hole 44 are brought into pressure contact with each other by four pressure-contacting portions of the pair of lateral pressure-contacting portions 31 and 31 and the pair of axial pressure-contacting portions 32 and 32, the bottle body 10 and the handle member 40 can be fixed firmly. Additionally, since the axial position of the handle member 40 is firmly fixed by the pair of axial pressure-contacting portions 32 and 32, even if the handle portion 42 is gripped and lifted, and a load along the axial direction acts on the handle member 40, the handle member is prevented from coming off from the bottle body 10. Additionally, since the mounting projecting portion 30 and the mounting hole 44 are brought into pressure contact with each other and fixed to each other by four pressure-contacting portions arranged at intervals of 90°, they can be reliably prevented from readily rotating relatively.

Additionally, since the engaging recessed groove 34 of the bottle body 10 and the annular locking portion 45 of the handle member 40 are engaged with each other, it is possible to further improve the mounting strength of the bottle body 10 and the handle member 40.

Moreover, in this embodiment, the abutting wall portion 46 which projects toward the inner peripheral side of the mounting hole 44 from the inner peripheral edge of the mounting hole 44 is formed on the front surface of the mounting portion 41, and the mounting projecting portion 30 abuts on and is fixed to the abutting wall portion 46. Thus, the mounting projecting portion 30 is sandwiched between the annular locking portion 45 and the abutting wall portion 46. As a result, it is possible to further improve the mounting strength of the bottle body 10 and the handle member 40.

Second Embodiment

Figure 8:
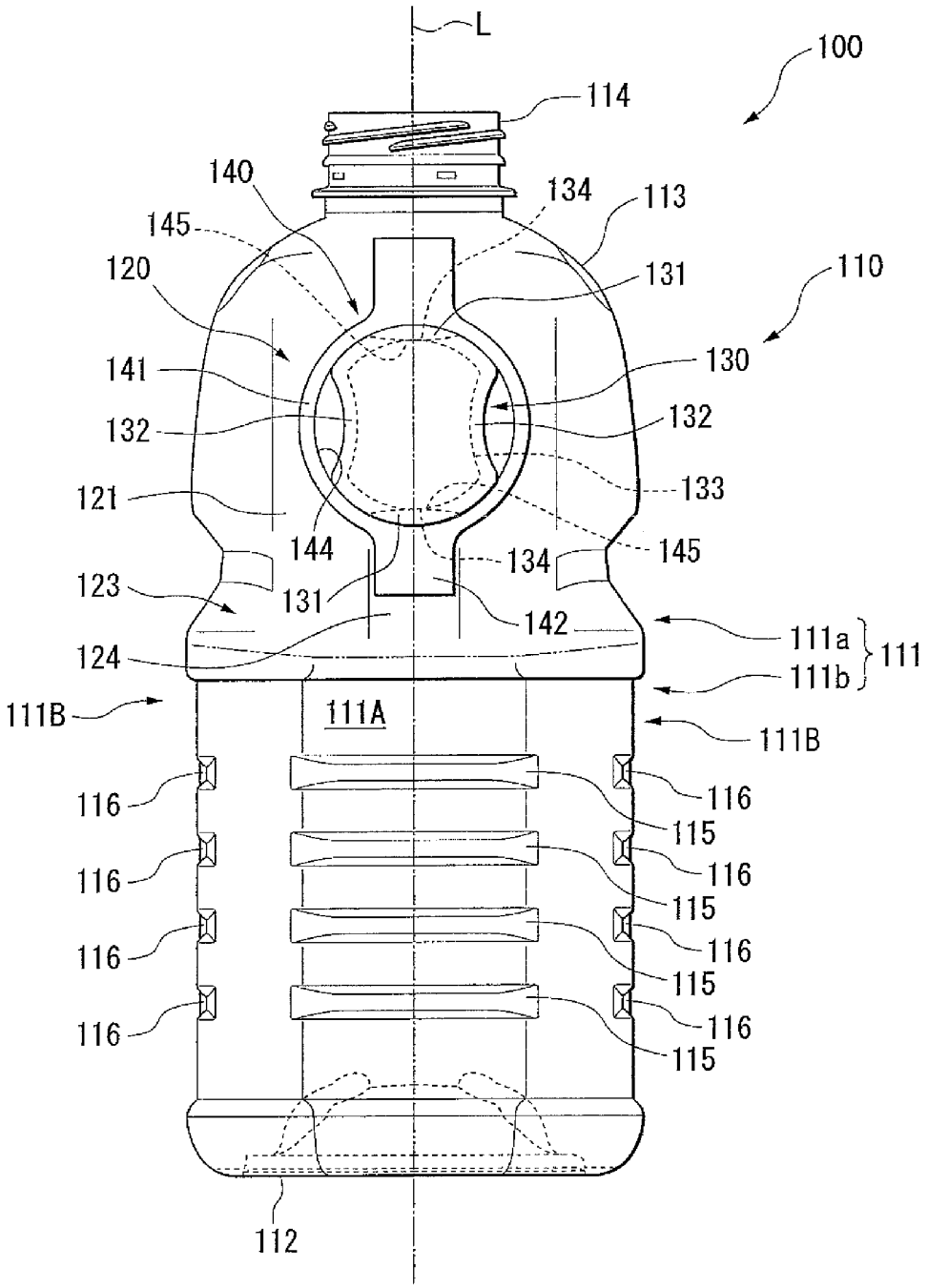
FIG. 8 is a side view of a bottle container with a handle which is a second embodiment of the invention.
Figure 9:
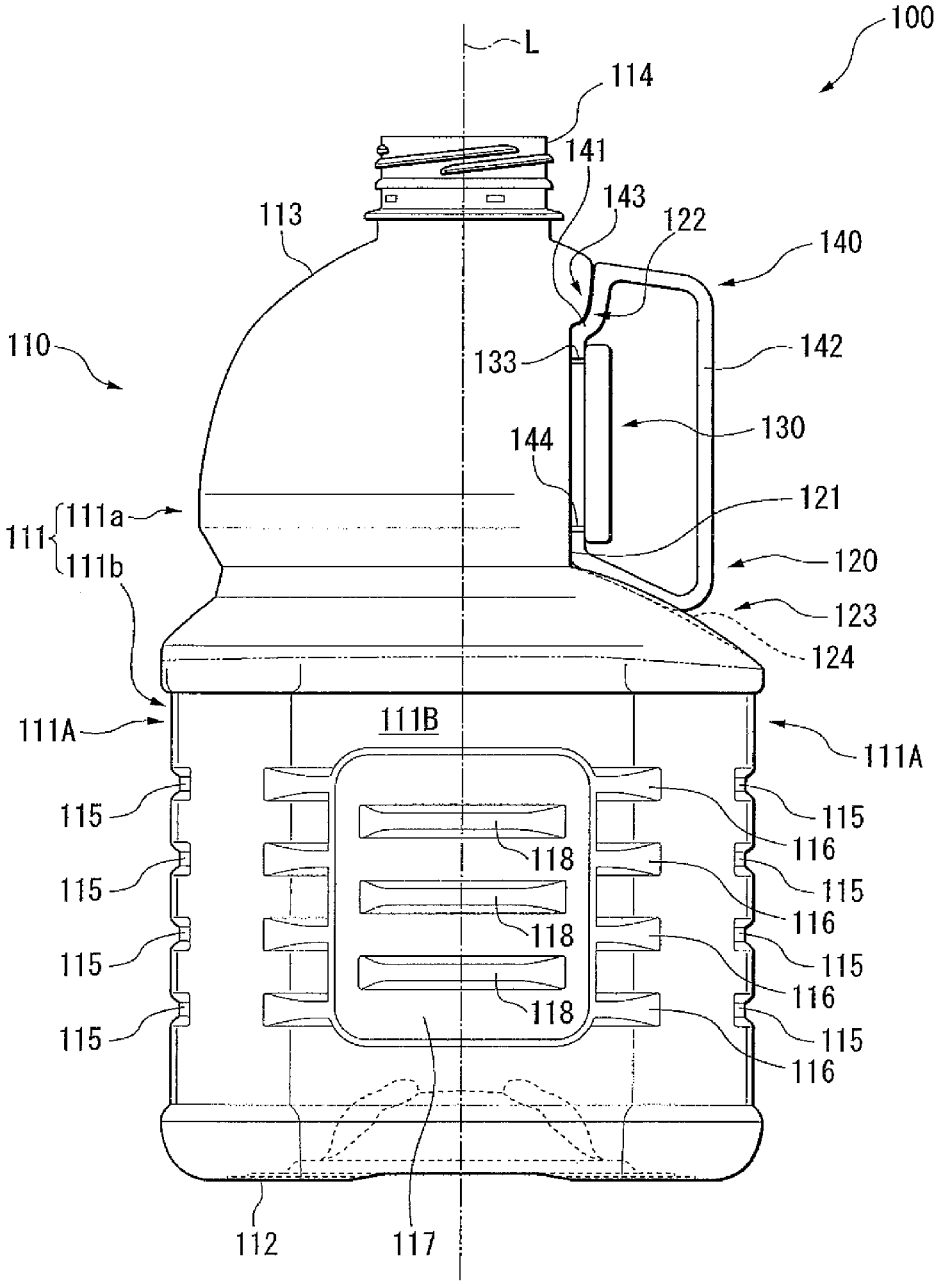
FIG. 9 is a side view of a bottle body which constitutes the bottle container with a handle shown in FIG. 8.
Figure 10:
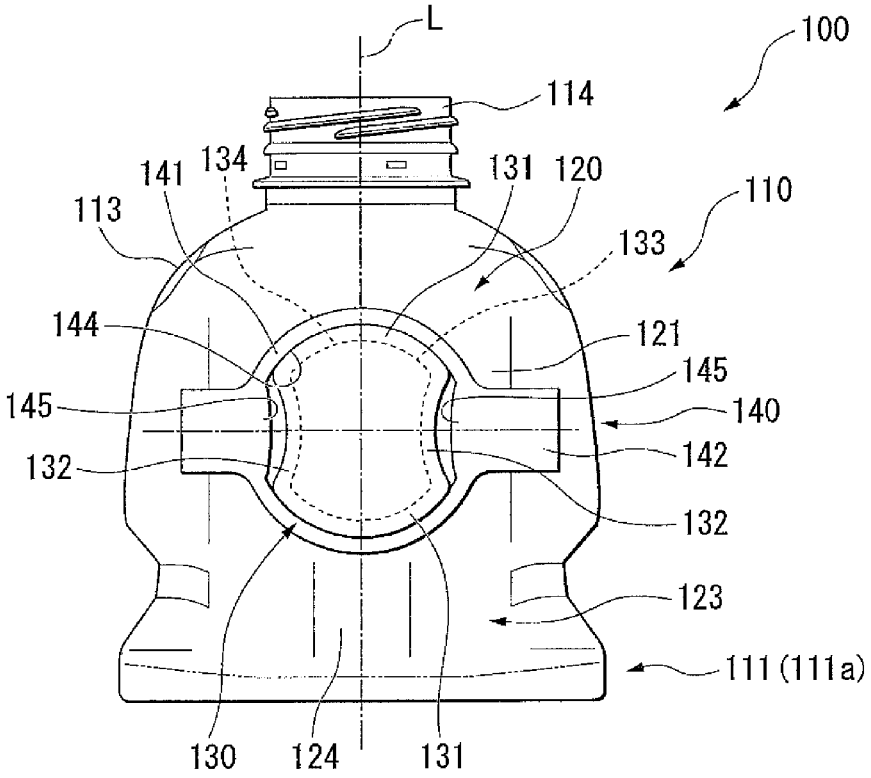
FIG. 10 is a front view when a mounting projecting portion of the bottle body shown in FIG. 9 is seen from the front.

A second embodiment of the invention will be described with reference to the accompanying drawings. A bottle container with a handle which is a second embodiment is shown in FIGS. 8 to 10.

The bottle container 100 with a handle has a bottle body 110, and a handle member 140 to be mounted on the bottle body 110.

The bottle body 110 includes a substantially rectangular tubular trunk portion 111 which extends along the bottle axis L, a bottom portion 112 which is connected to a lower end of the trunk portion 111, a shoulder portion 113 which is connected to an upper end of the trunk portion 111 and constructed such that its cross-sectional area becomes gradually small toward the upside, and a mouth portion 114 which is connected to an upper end portion of the shoulder portion 113 and extends toward the upside. The trunk portion 111, the bottom portion 112, the shoulder portion 113, and the mouth portion 114 are integrally formed from, for example, synthetic resins, such as polyethylene terephthalate (PET), with the bottle axis L as a common axis. The trunk portion 111 is made up of an upper trunk portion 111*a* on which the handle member 140 is mounted, and a lower trunk portion 111*b* formed in a substantially rectangular shape.

The lower trunk portion 111*b* of the trunk portion 111 includes a pair of short side wall surfaces 111A and 111A and a pair of long side wall surfaces 111B and 111B. The short side wall surfaces 111A and 111A face each other with the bottle axis L therebetween, and the long side wall surfaces 111B and 111B face each other with the bottle axis L therebetween. A plurality of (four as shown in FIG. 8 in this embodiment) recessed grooves 115 which extend in a peripheral direction of the trunk portion 111 are formed at intervals in the direction of the bottle axis L in each of the pair of short side wall surfaces 111A and 111A.

Additionally, a plurality of (four as shown in FIG. 9 in this embodiment) recessed grooves 116 which extend in the peripheral direction are formed in each of the pair of long side wall surfaces 111B and 111B similarly to the short side wall surface 111A, and a pressure reducing/absorbing panel 117 is provided in each long side wall surface so as to overlap the recessed grooves 116. A plurality of (three as shown in FIG. 9 in this embodiment) recessed grooves 118 which extend in the peripheral direction of the trunk portion 111 are formed at intervals in the direction of the bottle axis L inside the pressure reducing/absorbing panel 117.

Here, in the upper trunk portion 111*a*, a recessed portion 120 which is recessed toward the inside of the bottle body 110 is provided in a portion ranging from a portion connected to an upper end of one short side wall surface 111A (right one in FIG. 9) to the shoulder portion 113. The recessed portion 120 has a vertical wall 121 which extends parallel to the bottle axis L, an upper end of the vertical wall 121 is formed with a stepped portion 122 connected to the shoulder portion 113, and a lower end thereof is formed with a slope portion 123 connected to the lower trunk portion 111*b*.

A mounting projecting portion 130 projects from the recessed portion 120 so as to project toward one side from the vertical wall 121.

The mounting projecting portion 130 forms a shape in which middle portions of a circle in the up-down direction are recessed radially inward, as shown in FIGS. 8 and 10 as seen from the side which faces its projecting direction. In detail, upper and lower portions of the mounting projecting portion 130 are respectively formed as convexly curved portions 131 which become convex toward an up-down direction, and portions which intersect the up-down direction at 90° are respectively formed as concavely curved portions 132 which are recessed radially inward.

Here, a convex curve formed by the convexly curved portion 131 is formed as a circular arc with a diameter approximately equal to the internal diameter of a mounting hole 144 of the handle member 140 (described later).

An engaging recessed groove 133 whose depth is constant is formed in the mounting projecting portion 130 between the vertical wall 121 and the mounting projecting portion, and elastically deformable portions 134 which become convex toward the up-down direction are respectively provided at the upper and lower portions of the engaging recessed groove 133.

The slope portion 123 located below the mounting projecting portion 130 is formed with a locking recessed portion 124 which is recessed toward the inside of the bottle body 110 and extends in the direction of bottle axis L as seen from the side which faces the short side wall surface 111A. In addition, the locking recessed portion 124 has width and depth enough to accommodate a portion of the handle portion 142 (described later) therein.

Next, the handle member 140 will be described. The handle member 140 includes a substantially disc-like mounting portion 141, and a handle portion 142 which extends from the mounting portion 141, and the mounting portions 141 and the handle portion 142 are molded integrally. In detail, the handle portion 142 extends from upper and lower ends of the mounting portion 141 in a state where the mounting member 140 has been mounted on the bottle body 110. Additionally, the portion extending from the upper end and the portion extending from the lower end are connected together so as to extend in the direction of the bottle axis L in a position away from the mounting projecting portion 130. This allows the handle member 140 to form an annular shape as shown in FIG. 9 in side view. A step portion 143 having a shape corresponding to the outer contour of the stepped portion 122 provided at the upper end of the recessed portion 120 is formed at an upper connected portion between the mounting portion 141 and the handle portion 142.

The mounting portion 141 is formed with a mounting hole 144 which forms a substantially circular cross-sectional shape. Here, pressing portions 145 which project radially inward are provided at upper and lower portions (portions to which the handle portion 142 is connected) of the mounting hole 144. The projection height of the pressing portions 145 is set to be smaller than the recessed distance of the concavely curved portions 132 of the mounting projecting portion 130.

The bottle container 100 with a handle which is this embodiment is constructed by mounting this handle member 140 on the bottle body 110 as follows.

First, as shown in FIG. 10, an arrangement is made such that the handle member 140 intersects at 90° with respect to the bottle axis L of the bottle body 110, i.e., the pressing portions 145 of the handle member 140 face the concavely curved portions 132, respectively, of the mounting projecting portion 130. Here, since the convex curves formed by the convexly curved portions 131 of the mounting projecting portion 130 are formed as circular arcs of almost the same diameter as the internal diameter of the mounting hole 144 of the handle member 140, and the projection height of the pressing portions 145 is set to be smaller than the recessed distance of the concavely curved portions 132 of the mounting projecting portion 130, it becomes possible to insert the mounting projecting portion 130 into the mounting hole 144.

After the mounting projecting portion 130 is inserted into the mounting hole 144 in this way, the handle member 140 is rotated by 90°. The elastically deformable portions 134 of the mounting projecting portion 130 are pressed by the pressing portions 145 of the mounting hole 144 to be elastically deformed so as to be recessed radially inward of the mounting projecting portion 130, and the mounting hole 144 and the mounting projecting portion 130 are brought into pressure contact with each other. This allows the handle member 140 to be mounted on the bottle body 110.

The portion of the handle portion 142 which extends from the lower end of the mounting portion 141 is accommodated in the locking recessed portion 124 formed in the slope portion 123 of the recessed portion 120.

In this way, the bottle container 100 with a handle which is this embodiment is constructed. In addition, in a state where the handle member 140 is mounted, as shown in FIG. 8, the handle member 140 is constructed so as to be located more inside than an outer peripheral portion of a lower portion of the trunk portion 111.

In the bottle container 100 with a handle constructed as such, the portion of the handle portion 142 extending from the lower end of the mounting portion 141 is fitted into the locking recessed portion 124 provided in the bottle body 110 in a state where the handle member 140 has been mounted on the bottle body 110. Thus, even if the handle member 140 tends to rotate relative to the mounting projecting portion 130, the portion of the handle portion 142 is locked to the locking recessed portion 124, thereby preventing relative rotation. Accordingly, when the handle portion 142 is gripped and handled, the bottle body 110 and the handle member 140 can be prevented from being disengaged from each other readily, and a problem that the bottle body 110 falls and its contents leak can be prevented beforehand.

Additionally, the relative rotation of the handle member 140 and the bottle body 110 is prevented by the locking recessed portion 124. Thus, like this embodiment, even if the mounting hole 144 of the handle member 140 is formed in a substantially circular cross-sectional shape, and the mounting projecting portion 130 is formed in a shape in which a portion of a circle which can be inserted into the mounting hole 144 is cutout, the handle member 140 can be prevented from coming off unexpectedly. Consequently, the mounting projecting portion 130 and the handle member 140 can be formed in a relatively simple shape, and the handle member 140 and the bottle body 110 can be manufactured at low cost.

Moreover, since the upper and lower portions of the engaging recessed groove 133 of the mounting projecting portion 130 are provided with the elastically deformable portions 134 which are elastically deformed by the pressing portions 145 of the mounting hole 144, the mounting projecting portion 130 and the mounting hole 144 can be brought into pressure contact with each other to firmly fix the handle member 140, and the relative rotation of the bottle body 110 and the handle member 140 can be more reliably prevented by the pressure contact. Additionally, since the position of the handle member 140 in the up-down direction is firmly fixed, even if the handle portion 142 is gripped and lifted, and a load along the up-down direction acts on the handle member 140, the bottle body 110 and the handle member 140 can be prevented from being disengaged from each other.

Third Embodiment

Figure 11:
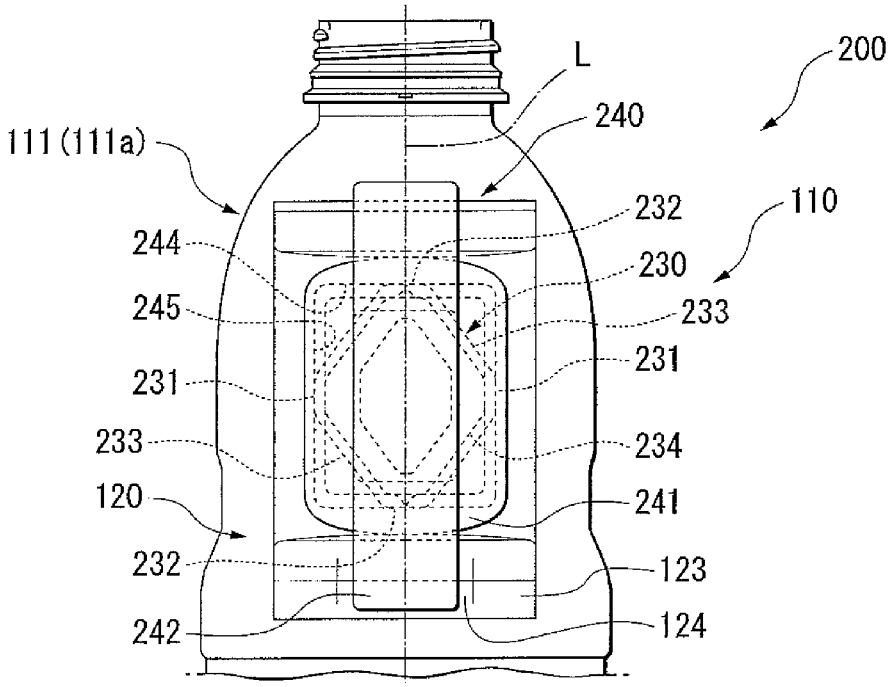
FIG. 11 is a front view of a handle member which constitutes a bottle container with a handle which is a third embodiment of the invention.

Next, a third embodiment of the invention will be described with reference to FIG. 11. The same components as those of the second embodiment will be denoted by the same reference numerals, and the detailed description thereof will be omitted.

In the third embodiment, the shapes of a mounting projecting portion 230 and a mounting hole 244 differ from those of the second embodiment, and are similar to the shapes in the first embodiment.

The mounting projecting portion 230 forms an octagonal cross-sectional shape, and includes a pair of lateral pressure-contacting portions 231 and 231 which extend along the bottle axis L, a pair of axial pressure-contacting portions 232 and 232 which extend in a direction orthogonal to the bottle axis L and along an external surface of the bottle body 110, and four oblique side portions 233 which connect the lateral pressure-contacting portions 231 and the axial pressure-contacting portions 232. A pair of facing oblique side portions 233 and 233 of the four oblique side portions 233 is also arranged parallel to each other.

Here, the distance between the lateral pressure-contacting portions 231 and 231 is set to be greater than the distance between the pair of facing oblique side portions 233 and 233. Additionally, the length of the lateral pressure-contacting portion 231 is set to be shorter than that of the oblique side portion 233 and to be longer than that of the axial pressure-contacting portion 232. Additionally, an engaging recessed groove 234 is formed on the mounting projecting portion 230 between the vertical wall 121 and the mounting projecting portion.

The handle member 240 includes a substantially rectangular flat-plate-shaped mounting portion 241, and a handle portion 242 which is erected from a front surface of the mounting portion 241, and the mounting portions 241 and the handle portion 242 are molded integrally. The mounting portion 241 is formed with a mounting hole 244 which forms a substantially rectangular cross-sectional shape. Here, the distance between long sides of the mounting hole 244 is set to be approximately equal to the distance between the lateral pressure-contacting portions 231 and 231 of the mounting projecting portion 230 and to be greater than the distance between the pair of facing oblique side portions 233 and 233 of the mounting projecting portion 230. Additionally, the distance between short sides of the mounting hole 244 is set to be approximately equal to the distance between the axial pressure-contacting portions 232 and 232 of the mounting projecting portion 230.

An annular locking portion 245 is formed on a rear surface of the mounting portion 241 so as to protrude toward the inner peripheral side of the mounting hole 244 from an inner peripheral edge of the mounting hole 244. The distance between long sides of the annular locking portion 245 is set to be approximately equal to the distance between the oblique side portions 233 and 233 of the mounting projecting portion 230. Additionally, the distance between short sides of the annular locking portion 245 is set to be smaller than the distance between the axial pressure-contacting portions 232 and 232 of the mounting projecting portion 230.

An arrangement is made such that this handle member 240 is inclined with respect to the bottle axis L of the bottle body 10, i.e., the long sides of the mounting hole 244 of the handle member 240 become parallel to the pair of oblique side portions 233 and 233 of the mounting projecting portion 230. Here, since the distance between the long sides of the annular locking portion 245 is set to be approximately equal to the distance between the pair of facing oblique side portions 233 and 233 of the mounting projecting portion 230 and the distance between the long sides of the mounting hole 244 is set to be greater than the distance between the pair of facing oblique side portions 233 and 233 of the mounting projecting portion 230, it becomes possible to insert the mounting projecting portion 230 into the mounting hole 244.

In a state where the mounting projecting portion 230 has been inserted into the mounting hole 244 in this way, the handle member 240 is turned, and is arranged such that the long sides of the mounting hole 244 become parallel to the bottle axis L of the bottle body 110.

Then, a pair of short side portions of the mounting hole 244 are respectively brought into pressure contact with the axial pressure-contacting portions 232 and 232 of the mounting projecting portion 230, a pair of long side portions of the mounting hole 244 are respectively brought into pressure contact with the lateral pressure-contacting portions 231 and 231 of the mounting projecting portion 230. Additionally, the annular locking portion 245 and the engaging recessed groove 234 of the mounting projecting portion 230 are engaged with each other. This allows the handle member 240 to be mounted on the bottle body 110.

In this way, the bottle container 200 with a handle which is this embodiment is constructed. In addition, in a state where the handle member 240 is mounted, as shown in FIG. 8, the handle member 240 is constructed so as to be located more inside than an outer peripheral portion of a lower portion of the trunk portion 111.

In the bottle container 200 with a handle of this construction, the mounting projecting portion 230 forms an octagonal cross-sectional shape, and the mounting hole 244 forms a substantially rectangular cross-sectional shape. Thus, in the state where the mounting projecting portion 230 and the mounting hole 244 are brought into pressure contact with each other, they are prevented from readily rotating relatively. Moreover, since the locking recessed portion 124 is provided as a rotation preventing member, the relative rotation of the bottle body 110 and the handle member 240 can be prevented reliably.

Accordingly, when the handle portion 242 is gripped and handled, the bottle body 110 and the handle member 240 can be prevented from being unexpectedly disengaged from each other.

Additionally, since the mounting projecting portion 230 and the mounting hole 244 are brought into pressure contact with each other by four pressure-contacting portions of the pair of lateral pressure-contacting portions 231 and 231 and the pair of axial pressure-contacting portions 232 and 232, the bottle body 110 and the handle member 240 can be fixed firmly to each other. Additionally, since the position of the handle member 240 in the up-down direction is firmly fixed by the pair of axial pressure-contacting portions 232 and 232, even if the handle portion 242 is gripped and raised, and a load along the up-down direction acts on the handle member 240, the bottle body 110 and the handle member 240 can be prevented from being disengaged from each other. Moreover, since the mounting projecting portion 230 and the mounting hole 244 are brought into pressure contact with each other and fixed to each other by four pressure-contacting portions arranged at intervals of 90°, they can be more reliably prevented from readily rotating relatively.

Fourth Embodiment

A fourth embodiment of the invention will be described with reference to FIGS. 12 to 14.

Figure 12:
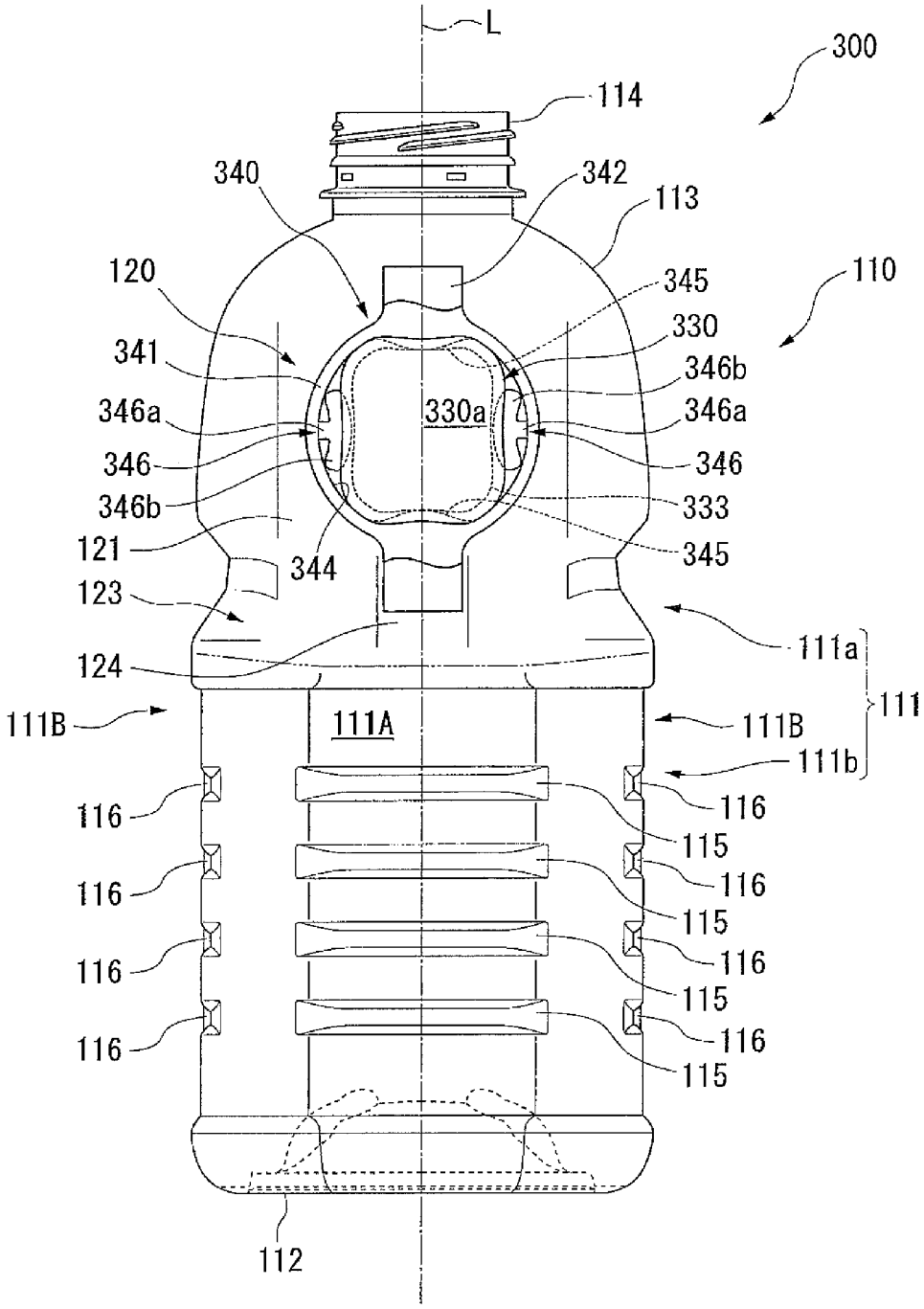
FIG. 12 is a side view of a bottle container with a handle which is a fourth embodiment of the invention.
Figure 13:
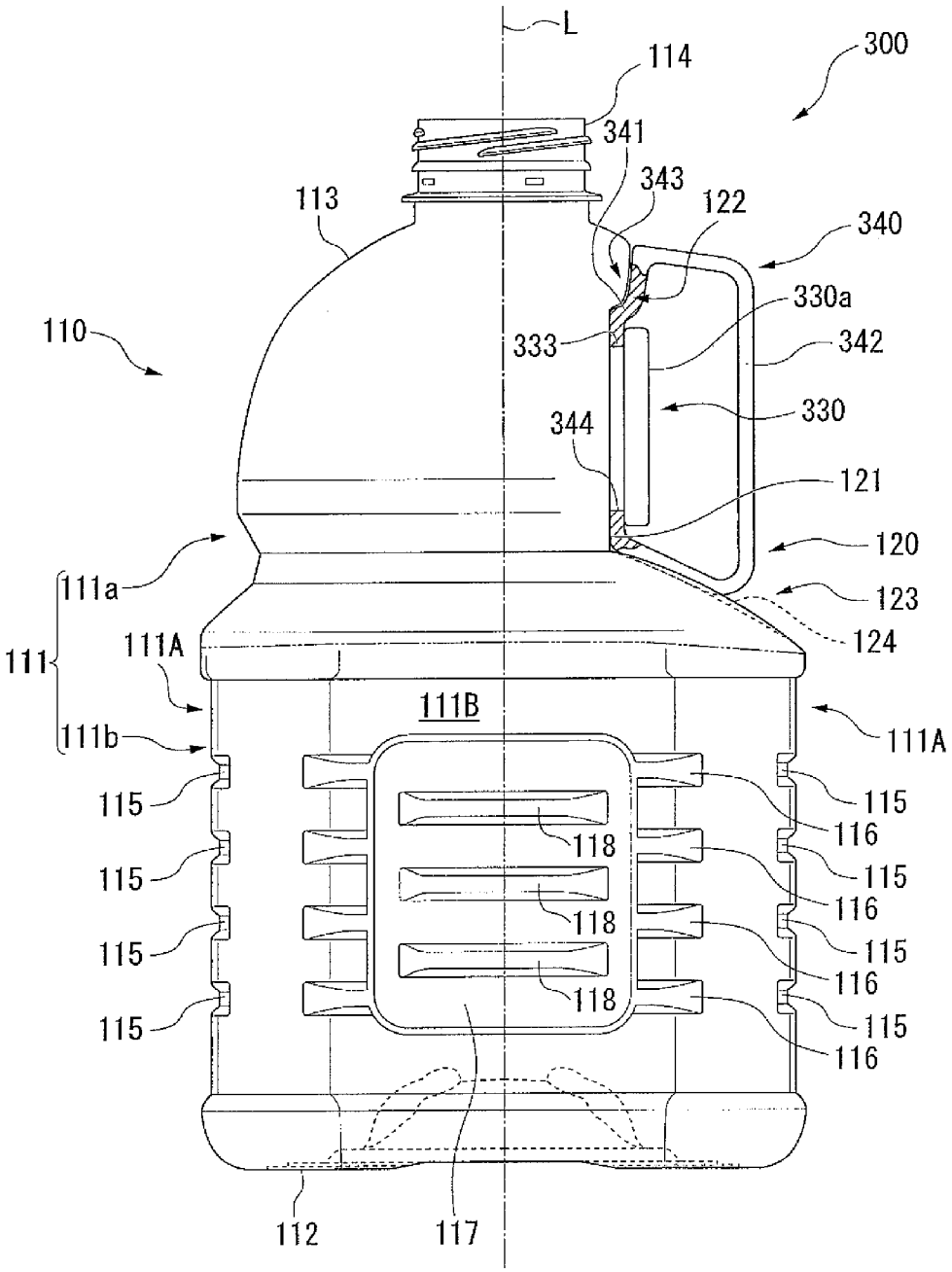
FIG. 13 is a side view of a bottle body which constitutes the bottle container with a handle shown in FIG. 12.
Figure 14:
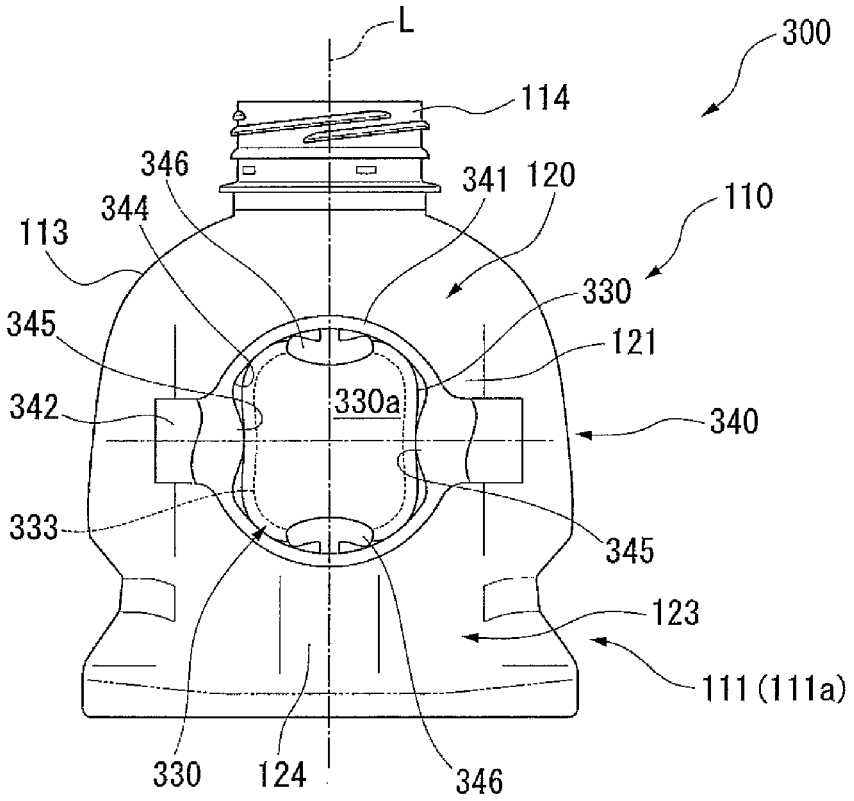
FIG. 14 is a front view when a mounting projecting portion of the bottle body shown in FIG. 13 is seen from the front.

FIG. 12 is a side view of a bottle container 300 with a handle as seen from a handle mounting surface, FIG. 13 is a side view of the bottle container 300 with a handle as seen from a direction orthogonal to the handle mounting surface, and FIG. 14 is a side view of the bottle container 300 with a handle showing an example in a state where a mounting projecting portion 330 (described later) is inserted into a mounting hole 344.

The same components as those of the second embodiment will be denoted by the same reference numerals, and the detailed description thereof will be omitted.

In the fourth embodiment, the construction of the mounting projecting portion 330 and a mounting portion 341 differs from the second embodiment.

The mounting projecting portion 330, as shown in FIG. 12, forms a substantially rectangular shape which is long in the up-down direction and is convexly curved at corners, as seen from the side which faces its projecting direction. A middle portion of the upper and lower ends and a middle portion of right and left ends in the mounting projecting portion 330 have a shape which is slightly recessed radially inward, and have a smoothly curved shape.

An engaging recessed groove 333 with a constant depth, which is directed radially inward of the mounting projecting portion 330, is formed on an outer peripheral surface of a proximal end of the mounting projecting portion 330 over its entire periphery.

The mounting portion 341 of the handle member 340 has a substantially annular shape, and is formed with a mounting hole 344 which forms a substantially circular cross-sectional shape.

Additionally, an inner peripheral surface of the mounting hole 344 is provided with a pair of abutting portions 345 and 345 which are arranged so as to sandwich the mounting projecting portion 330 from both sides in the direction of the bottle axis L in a state where the handle member 340 is mounted on the mounting projecting portion 330. That is, the abutting portions 345 and 345 are respectively provided so as to protrude radially inward from inner peripheral surfaces of upper and lower portions (portions to which the handle portion 342 are connected) of the mounting hole 344, and tip faces of the abutting portions 345 and 345 form a curved surface which is curved gently. Note that the shape of the abutting portion 345 and 345 may be, for example, polygonal shapes, such as a trapezoidal shape. Additionally, in the illustrated example, each of the abutting portions 345 and 345 is brought into pressure contact with a bottom surface of the engaging recessed groove 333, and at least one of the abutting portions 345 and 345 and the bottom surface of the above engaging recessed groove 333 is elastically deformed in a direction away from the other.

Note that the abutting portions 345 and 345 and the bottom surface of the engaging recessed groove 333 may be simply brought into contact with each other without being elastically deformed as mentioned above. Additionally, the abutting portion 345 of a pair of abutting portions 345 and 345 which is located on the side of the mouth portion 114 of the bottle body 110, i.e., on the upper side, in a state where the handle member 340 is mounted on the mounting projecting portion 330 may be sandwiched from both sides in the direction of the bottle axis L between the bottom surface of the engaging recessed groove 333 and the stepped portion 122.

Additionally, the inner peripheral surface of the mounting hole 344 is provided with a pair of retaining portions 346 and 346 which are arranged so as to sandwich the mounting projecting portion 330 from both the right and left sides in a state where the handle member 340 is mounted on the mounting projecting portion 330. That is, the retaining portions 346 and 346 are respectively provided so as to project radially inward from inner peripheral surfaces of right and left portions of the mounting hole 344. Each retaining portion 346 forms a substantially T-shape as a whole, and is made up of a proximal end portion 346*a* connected from the inner peripheral surface of the mounting hole 344, and a distal end portion 346*b* provided at the tip of the proximal end portion 346*a*. The distal end portion 346*b* forms a shape which is curved in a circular arc shape along the peripheral direction of the mounting hole 344. Both ends of the distal end portion 346*b* are brought close to or abut on the inner peripheral surface of the mounting hole 344, and a middle portion of the tip face of the distal end portion 346*b* is brought close to the bottom surface of the engaging recessed groove 333.

Note that the tip face of the distal end portion 346*b* may abut on the bottom surface of the engaging recessed groove 333. In this case, the handle member 340 is supported at four points by the mounting projecting portion 330 in a state where the handle member 340 is mounted on the mounting projecting portion 330. Accordingly, relative rotation of the handle member 340 and the bottle body 110 is further prevented, and the bottle body 110 and the handle member 340 can be fixed more firmly to each other.

The bottle container 300 with a handle which is this embodiment is constructed by mounting this member 340 on the bottle body 110, for example, as follows.

First, as shown in FIG. 14, the mounting projecting portion 330 is inserted into the mounting hole 344, thereby arranging the handle member 340 on the bottle body 110. At this time, the handle member 340 is arranged such that the handle portion 342 extends in a direction of 90° with respect to the bottle axis L of the bottle body 110. That is, the handle member 340 is arranged such that the pair of abutting portions 345 and 345 is arranged on the right and left, and the tip faces of the abutting portions face portions located on both the right and left sides in the bottom surface of the engaging recessed groove 333. Here, the pair of retaining portions 346 and 346 arranged in the upper and lower portions is pressed against a tip face 330*a* of the mounting projecting portion 330, and the distal end portion 346*b* is located on the tip face 330*a* of the mounting projecting portion 330 in a state where the proximal end portion 346*a* is elastically deformed radially outward of the bottle.

After the mounting projecting portion 330 is inserted into the mounting hole 344 in this way, the handle member 340 is rotated by 90° relative to the bottle body 110. With this rotation, the respective distal end portions 346*b* and 346*b* of the pair of retaining portions 346 and 346 come off from the tip face 330*a* of the mounting projecting portion 330, and are housed inside the engaging recessed groove 333 by an elastic restoring force which is directed radially inward of the bottle, of the proximal end portions 346*a* of the retaining portions 346 and 346. In this case, the pair of retaining portions 346 and 346 can be easily housed inside the engaging recessed groove 333 by slidingly moving the handle member 340 in both right and left directions, respectively. Additionally, with the above rotation, the pair of abutting portions 345 and 345 presses the bottom surface of the engaging recessed groove 333, respectively, and the tip faces of the pair of abutting portions 345 and 345 and the bottom surface of the engaging recessed groove 333 are brought into pressure contact with each other.

From the above, the handle member 340 is mounted on the bottle body 110.

The portion of the handle portion 342 which extends from the lower end of the mounting portion 341 is accommodated in the locking recessed portion 124 formed in the slope portion 123 of the recessed portion 120.

Note that the retaining portion 346 may be housed inside the engaging recessed groove 333 at the beginning of mounting the handle member 340 on the bottle body 110, i.e., when the mounting projecting portion 330 is inserted into the mounting hole 344.

In this way, the bottle container 300 with a handle which is this embodiment is constructed. In a state where the handle member 340 is mounted, as shown in FIG. 12, the handle member 340 is constructed so as to be located more inside than an outer peripheral portion of the lower trunk portion 111*b* of the trunk portion 111.

According to the bottle container 300 with a handle having the aforementioned construction, the pair of retaining portions 346 and 346 is housed inside the engaging recessed groove 333 in a state where the handle member 340 is mounted on the bottle body 110. Accordingly, even if an external force (a force which pulls out the mounting projecting portion 330 from the mounting hole 344) which is directed radially outward of the bottle acts on the handle member 340, the retaining portions 346 and 346 are caught by the inner surface of the engaging recessed groove 333. Therefore, the handle member 340 can be prevented from coming off from the bottle body 110. Additionally, at this time, the pair of abutting portions 345 and 345 is brought into pressure contact with the bottom surface of the engaging recessed groove 333. Thus, relative rotation of the handle member 340 and the bottle body 110 after the handle member 340 is mounted is prevented. Accordingly, the handle member 340 mounted on the bottle body 110 can be prevented from coming off.

Additionally, according to the bottle container 300 with a handle having the aforementioned construction, the pair of abutting portions 345 and 345 is arranged so as to sandwich the mounting projecting portion 330 from both upper and lower sides, and the pair of retaining portions 346 and 346 is arranged so as to sandwich the mounting projecting portion 330 from both the right and left sides. Accordingly, when the handle portion 342 is gripped and lifted, the weight of the bottle body 110 is firmly supported by the pair of abutting portions 345 and 345. This can further prevent the handle member 340 mounted on the bottle body 310 from coming off.

Additionally, according to the bottle container 300 with a handle having the aforementioned construction, the portion of the handle portion 342 extending from the lower end of the mounting portion 341 is accommodated in the locking recessed portion 124 provided in the bottle body 110 in a state where the handle member 340 is mounted on the bottle body 110. Therefore, even if the handle member 340 tends to rotate relative to the mounting projecting portion 330, the portion of the handle portion 342 is locked to the locking recessed portion 124. Accordingly, relative rotation of the handle portion 342 and the bottle body 110 can be prevented more reliably.

Fifth Embodiment

A fifth embodiment of the invention will be described with reference to FIGS. 15 to 17.

Figure 15:
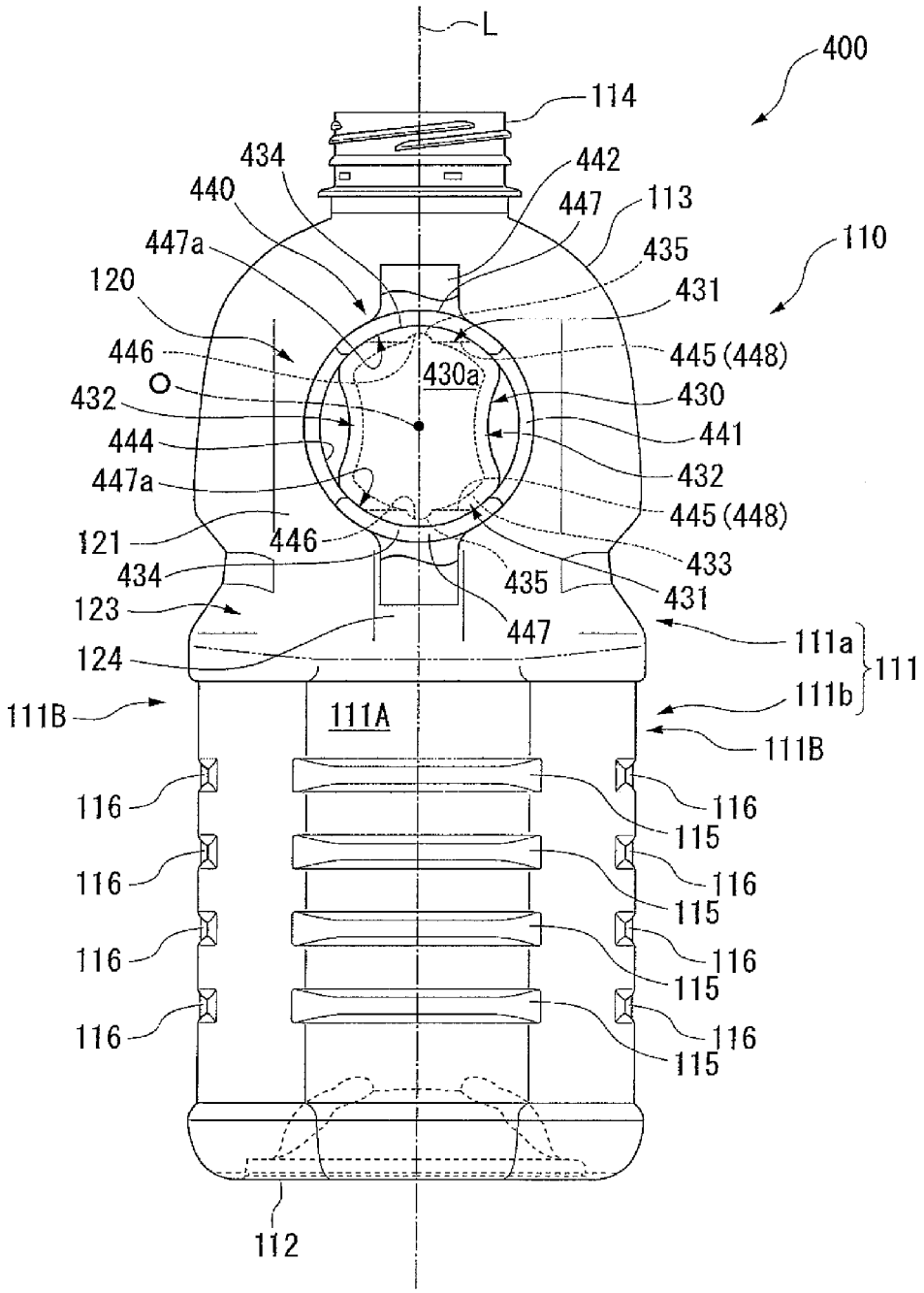
FIG. 15 is a side view of a bottle container with a handle which is a fifth embodiment of the invention.
Figure 16:
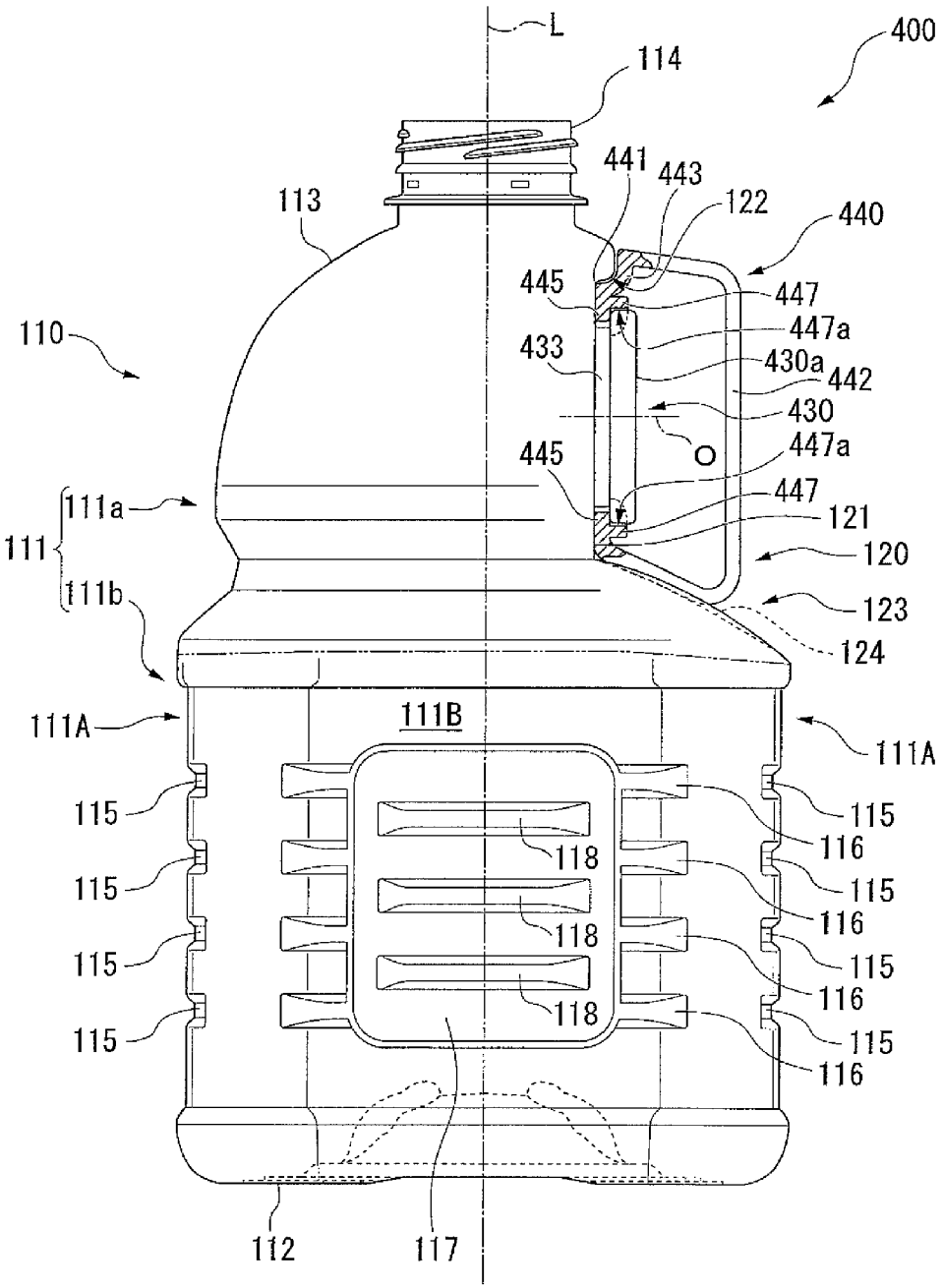
FIG. 16 is a side view of a bottle body which constitutes the bottle container with a handle shown in FIG. 15.
Figure 17:
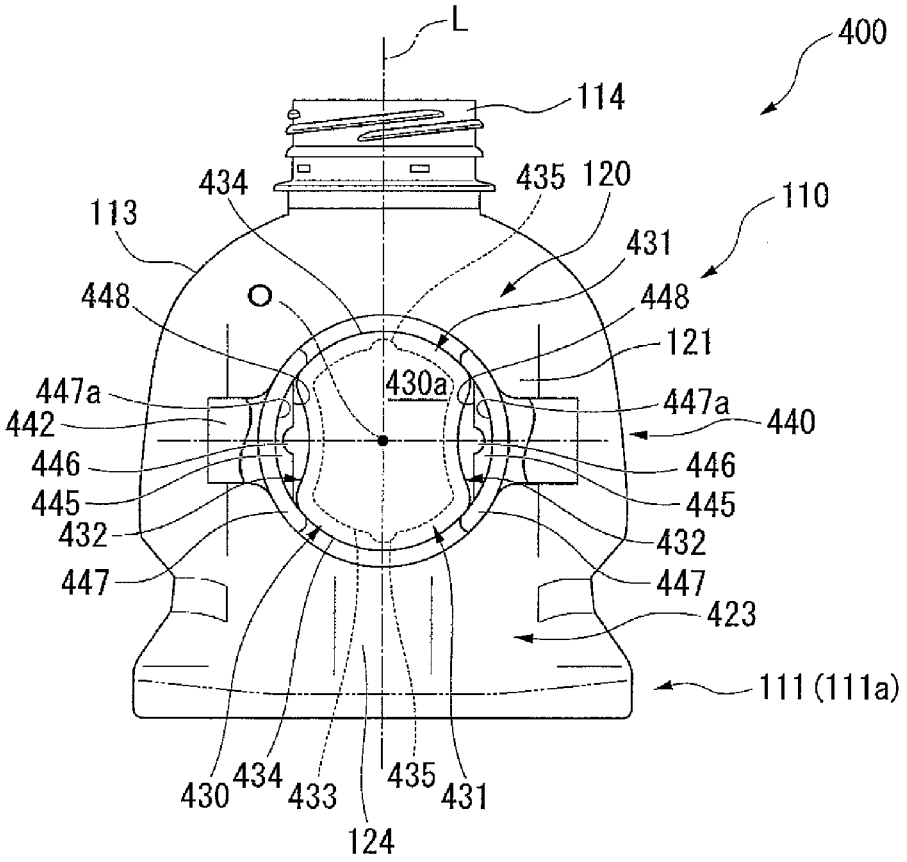
FIG. 17 is a front view when a mounting projecting portion of the bottle body shown in FIG. 16 is seen from the front.

FIG. 15 is a side view of a bottle container 400 with a handle as seen from a handle mounting surface, FIG. 16 is a side view of the bottle container 400 with a handle as seen from a direction orthogonal to the handle mounting surface, and FIG. 17 is a side view of the bottle container 400 with a handle showing a state where a mounting projecting portion 430 (described later) is inserted into a mounting hole 444.

In addition, the same components as those of the second embodiment will be denoted by the same reference numerals, and the detailed description thereof will be omitted.

In the fifth embodiment, the construction of the mounting projecting portion 430 and a mounting portion 441 differs from the second embodiment.

The mounting projecting portion 430, as shown in FIG. 15, forms a shape such that middle portions of a circle in the up-down direction are recessed radially inward, as seen from the side which faces its projecting direction. In detail, upper and lower portions of the mounting projecting portion 430 are respectively formed as convexly curved portions 431 which become convex in a circular arc shape toward an up-down direction, and side surface portions on both right and left sides of the mounting projecting portion 430 are respectively formed as concavely curved portions 432 which are recessed in a circular are shape radially inward.

A convex curve formed by the convexly curved portion 431 is formed as a circular arc with a diameter approximately equal to the internal diameter of a mounting hole 444 of a handle member 440 (described later).

An engaging recessed groove 433 with a constant depth, which is directed radially inward of the mounting projecting portion 430, is formed at an outer peripheral surface of a proximal end portion of the mounting projecting portion 430 over its entire periphery. A bottom surface of the engaging recessed groove 433 is formed with projecting portions 435 which project radially outward from the mounting projecting portion 430. The projecting portions 435 are respectively provided in the positions of upper and lower ends of the mounting projecting portion 430 on the bottom surface of the engaging recessed groove 433. That is, the projecting portions 435 are respectively arranged on the bottom surface of the engaging recessed groove 433 in middle positions of the upper and lower convexly curved portions 431. Additionally, the projecting portion 435 is engaged with a recessed portion 446 (described later) when the handle member 440 is mounted on the mounting projecting portion 430, and is a substantially semicircular projection.

Additionally, the outer peripheral surfaces of the upper and lower portions of the mounting projecting portion 430 are respectively formed with circular-arc sliding surfaces 434 which extend along an imaginary circumference having a central axis O of the mounting projecting portion 430 as a center. That is, an outer peripheral surface of the convexly curved portion 431 which is curved in a circular arc shape as seen from the side which faces the projecting direction of the mounting projecting portion 430 is the aforementioned sliding surface 434.

The mounting portion 441 of the handle member 440 has a substantially annular shape, and is formed with a mounting hole 444 which forms a substantially circular cross-sectional shape. The mounting hole 444 is a circular hole into which the mounting projecting portion 430 is inserted, and the internal diameter of the mounting hole 444 becomes approximately equal to the diameter of the mounting projecting portion 430 in its longitudinal direction (up-down direction). In addition, the surface of the mounting portion 441 on the radial inside of the bottle abuts on the vertical wall 121.

An inner peripheral surface of the mounting hole 444 is provided with a pair of abutting portions 445 and 445 which is arranged so as to sandwich the mounting projecting portion 430 from both sides in the direction of the bottle axis L in a state where the handle member 440 is mounted on the mounting projecting portion 430. That is, the abutting portions 445 and 445 are respectively provided at inner peripheral surfaces of upper and lower portions (portions to which the handle portion 442 is connected) of the mounting hole 444. Each of the abutting portions 445 and 445 is constructed such that the recessed portion 446 which is recessed radially outward of the mounting hole 444 is formed in the middle of a planar portion 448 which forms a chord on the inner peripheral surface of the mounting hole 444, as seen from the side which faces the projecting direction of the mounting projecting portion 430. The recessed portion 446 is engaged with the projecting portion 435 when the handle member 440 is mounted on the mounting projecting portion 430, and has a shape which is curved in a circular arc shape. Note that the shapes of the recessed portion 446 and the projecting portion 435 may be polygons, such as a trapezoid.

Additionally, in the illustrated example, each of the abutting portions 445 and 445 is brought into pressure contact with a bottom surface of the above engaging recessed groove 433, and at least one of the abutting portions 445 and 445 and the bottom surface of the engaging recessed groove 433 is elastically deformed in a direction away from the other. Note that the abutting portions 445 and 445 and the bottom surface of the engaging recessed groove 433 may be simply brought into contact with each other without being elastically deformed as mentioned above.

Moreover, the abutting portion 445 on the side (upside) of the mouth portion of the container may be sandwiched between the bottom surface of the engaging recessed groove 433 and the stepped portion 122.

Additionally, guide portions 447 which slide on the sliding surface 434 with the relative rotation of the handle member 440 and the bottle body 110 to guide the relative rotation are provided so as to project from the surface (the surface opposite a surface which abuts on the vertical wall 121) of the mounting portion 441 on the radial outside of the bottle. Each guide portion 447 extends along an imaginary circumference having a central axis O of the mounting projecting portion 430 as a center. That is, the guide portion 447 is an arched wall portion which is curved in a circular arc shape, and an inner peripheral surface (side surface which is directed to the inside of the mounting hole 444) of the guide portion 447 is a circular-arc surface 447*a* which extends along the sliding surface 434. Additionally, the guide portions 447 are disposed so as to sandwich the mounting projecting portion 430 from both sides in the up-down direction in a state where the handle member 440 is mounted on the mounting projecting portion 430. That is, the guide portions 447 are disposed at upper and lower portions (portions to which the handle portion 442 are connected) of the mounting portion 441 similarly to the aforementioned abutting portions 445 and 445, and the arc surface 447*a* of each guide portion is brought into sliding contact with the sliding surface 434 formed in the convexly curved portion 431 of the mounting projecting portion 430.

The bottle container 400 with a handle which is this embodiment is constructed by mounting this member 440 on the bottle body 110 as follows.

First, as shown in FIG. 17, the mounting projecting portion 430 is inserted into the mounting hole 444, thereby arranging the handle member 440 on the bottle body 110. At this time, the handle member 440 is arranged such that the handle portion 442 extends in a direction of 90° with respect to the bottle axis L of the bottle body 110. That is, the handle member 440 is arranged such that the pair of abutting portions 445 and 445 and the pair of guide portions 447 and 447 are arranged on the right and left, respectively, the tip faces of the pair of abutting portions 445 and 445 face the bottom surface of the engaging recessed groove 433 in the concavely curved portions 432, and the circular-arc surfaces 447*a* and 447*a* of the pair of guide portions 447 and 447 face the outer peripheral surfaces of the concavely curved portions 432.

Here, the guide portion 447 extends from the upper convexly curved portion 431 to the lower convexly curved portion 431, and is in a state where both ends thereof are brought into sliding contact with the upper and lower sliding surfaces 434 and 434, respectively, of the mounting projecting portion 430. Additionally, the abutting portion 445 is arranged inside a gap formed between the circular-arc surface 447*a* of the guide portion 447 and the outer peripheral surface of the concavely curved portion 432, as seen from the side which faces the projecting direction of the mounting projecting portion 430. When the mounting projecting portion 430 is inserted into the mounting hole 444, alignment is performed by the pair of guide portions 447 and 447, and the center positions of the mounting hole 444 and the mounting projecting portion 430 are aligned with each other.

After the mounting projecting portion 430 is inserted into the mounting hole 444 in this way, the handle member 440 and the bottle body 110 are rotated relative to each other around the central axis O of the mounting projecting portion 430. At this time, the circular-arc surfaces 447*a* of the guide portions 447 slide on the sliding surface 434 of the mounting projecting portion 430. With the above relative rotation, the abutting portions 445 and 445 are accommodated inside the engaging recessed groove 433. Then, when the bottle body 110 and the handle member 440 are rotated relative to each other by 90°, the abutting portions 445 and 445 abut on the bottom surface of the engaging recessed groove 433, and the recessed portion 446 is engaged with the projecting portion 435, thereby regulating the relative rotation of the bottle body 110 and the handle member 440.

From the above, the handle member 440 is mounted on the bottle body 110.

The portion of the handle portion 442 which extends from the lower end of the mounting portion 441 is accommodated in the locking recessed portion 124 formed in the slope portion 123 of the recessed portion 120.

In this way, the bottle container 400 with a handle which is this embodiment is constructed. In addition, in a state where the handle member 440 is mounted, as shown in FIG. 16, the handle member 440 is constructed so as to be located more inside than an outer peripheral portion of the lower trunk portion 111*b* of the trunk portion 111.

According to the bottle container 400 with a handle having the aforementioned construction, when the bottle body 110 and the handle member 440 are rotated relative to each other, the guide portions 447 slide on the sliding surface 434 of the mounting projecting portion 430. Accordingly, the relative rotation of the bottle body 110 and the handle member 440 is guided, and radial non-smoothness of the mounting projecting portion 430 is suppressed. Thereby, since the relative rotation of the bottle body 110 and the handle member 440 becomes a smooth circular motion, the bottle body 110 and the handle member 440 can be smoothly rotated relative to each other when the handle member 440 is mounted on the bottle body 110. Accordingly, the handle member 440 is easily mounted on the bottle body 110.

In addition, with the above relative rotation of the bottle body 110 and the handle member 440, the abutting portions 445 and 445 are accommodated inside the engaging recessed groove 433. Accordingly, even if an external force (a force which pulls out the mounting projecting portion 430 from the mounting hole 444) which is directed radially outward of the bottle acts on the handle member 440, the abutting portion 445 serves as a retainer, and is caught by the inner surface of the engaging recessed groove 433. For this reason, the handle member 440 does not come off from the bottle body 110.

Additionally, when the bottle body 110 and the handle member 440 are rotated relative to each other by 90°, the abutting portions 445 and 445 abut on the bottom surface of the engaging recessed groove 433. Therefore, the relative rotation of the bottle body 110 and the handle member 440 after mounting can be prevented. Additionally, radial looseness of the mounting projecting portion 430 after mounting of the handle member 440 can be suppressed. This allows the bottle body 110 and the handle member 440 to be firmly fixed to each other.

Additionally, according to the bottle container 400 with a handle having the aforementioned construction, the abutting portions 445 and 445 are disposed so as to sandwich the bottom surface of the engaging recessed groove 433 from both sides in the up-down direction in a state where the handle member 440 is mounted on the mounting projecting portion 430. Accordingly, when the handle member 440 is gripped and lifted, the bottle body 110 is firmly supported by the abutting portions 445 and 445. Accordingly, when the handle member 440 is held and handled, the handle member 440 can be more reliably prevented from coming off from the bottle body 110.

Additionally, according to the bottle container 400 with a handle having the aforementioned construction, the guide portion 447 is formed with the circular-arc surface 447*a* which extends along the sliding surface 434, and when the bottle body 110 and the handle member 440 are rotated relative to each other, the circular-arc surface 447*a* of the guide portion 447 slides on the sliding surface 434. Accordingly, the relative rotation of the bottle body 110 and the handle member 440 is guided more reliably. Thereby, radial non-smoothness of the mounting projecting portion 430 at the time of the aforementioned relative rotation can be suppressed more reliably. Additionally, since the pair of the guide portions 447 are disposed so as to sandwich the mounting projecting portion 430 therebetween in the radial direction thereof, the guide portions 447 sandwich the mounting projecting portion 430 from both sides. As a result, looseness of the handle member 440 after mounting can be further suppressed.

Additionally, according to the bottle container 400 with a handle having the aforementioned construction, the projecting portions 435 are formed at the upper and lower positions on the bottom surface of the engaging recessed groove 433 of the mounting projecting portion 430, and the recessed portions 446 are formed in the middle of the abutting portions 445 and 445. Accordingly, when the bottle body 110 and the handle member 440 are rotated relative to each other by 90°, the recessed portion 446 is engaged with the projecting portion 435, thereby regulating the relative rotation of the bottle body 110 and the handle member 440. That is, the termination position of the above relative rotation is determined by the projecting portions 435 and the recessed portions 446. Thereby, the handle member 440 is more easily mounted on the bottle body 110. Additionally, since the projecting portion 435 and the recessed portion 446 are engaged with each other when the handle member 440 is mounted on the bottle body 110, the relative rotation of the handle member 440 and the bottle body 110 after the handle member 440 has been mounted can be prevented more reliably, and the bottle body 110 and the handle member 440 can be fixed more firmly to each other.

Sixth Embodiment

A sixth embodiment of the invention will be described with reference to FIGS. 18 to 20.

Figure 18:
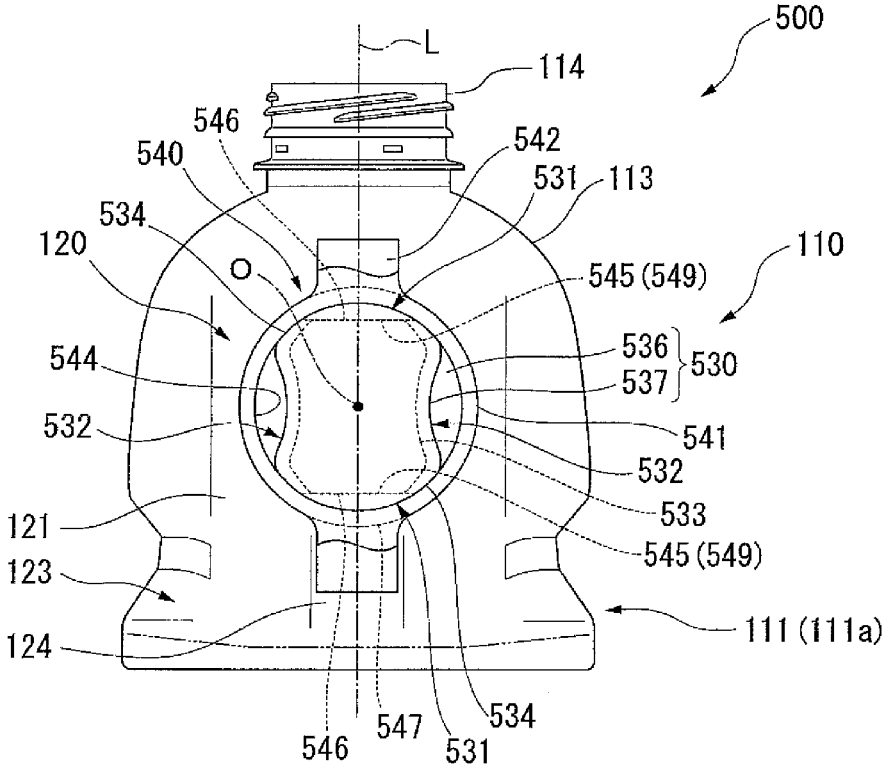
FIG. 18 is a side view of a bottle container with a handle which is a sixth embodiment of the invention.
Figure 19:
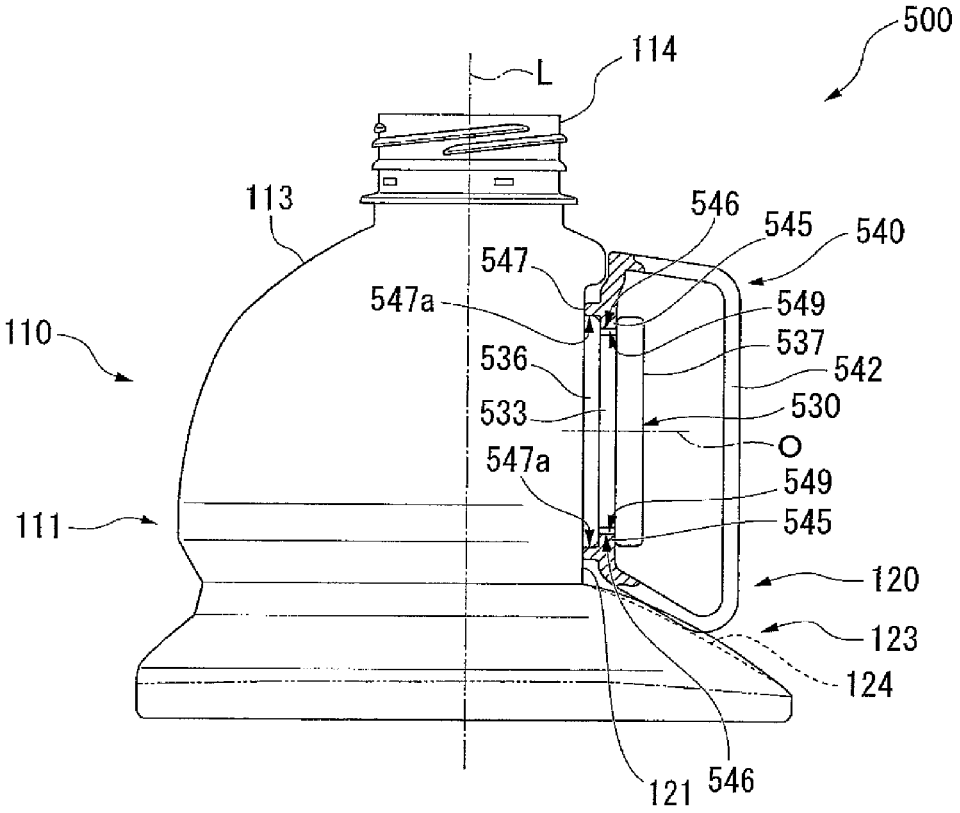
FIG. 19 is a side view of a bottle body which constitutes the bottle container with a handle shown in FIG. 18.
Figure 20:
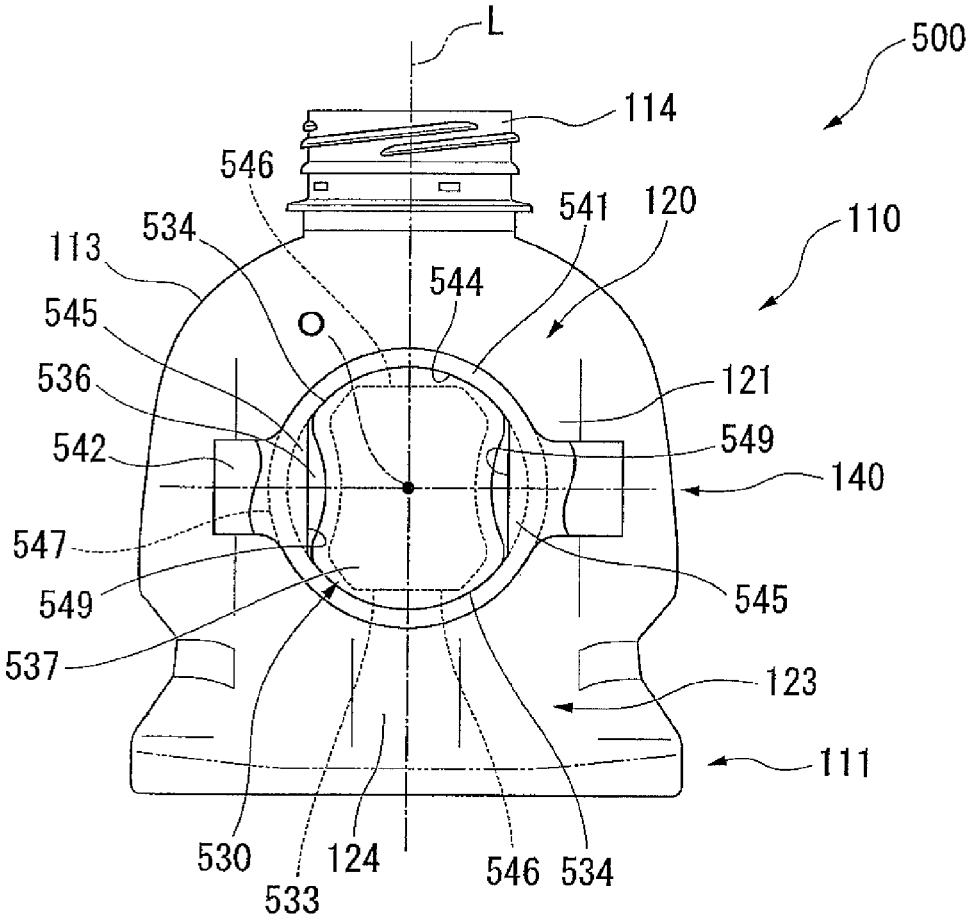
FIG. 20 is a front view when a mounting projecting portion of the bottle body shown in FIG. 19 is seen from the front.

FIG. 18 is a side view of a bottle container 500 with a handle as seen from a handle mounting surface, FIG. 19 is a side view of the bottle container 500 with a handle as seen from a direction orthogonal to the handle mounting surface, and FIG. 20 is a side view of the bottle container 500 with a handle showing a state where a mounting projecting portion 530 (described later) is inserted into a mounting hole 544.

Note that the same components as those of the second embodiment will be denoted by the same reference numerals, and the detailed description thereof will be omitted.

In the sixth embodiment, the construction of the mounting projecting portion 530 and a mounting portion 541 differs from the fifth embodiment.

The mounting projecting portion 530 in this embodiment is constructed such that a circular pedestal portion 536 is provided on the proximal side of the mounting projecting portion, and a mounting projecting portion body 537 is provided so as to project from a tip face of the circular pedestal portion 536. The circular pedestal portion 536 is a circular pedestal having the central axis O of the mounting projecting portion 530 as a center. An outer peripheral surface of the circular pedestal portion 536 serves as a sliding surface 534 with which an inner peripheral surface of a fitting hole 547*a* of a guide portion 547 (described later) is brought into sliding contact, and which extends along an imaginary circumference having the central axis O of the mounting projecting portion 530 as a center. The mounting projecting portion body 537 has the same external shape as the mounting projecting portion 430 in the above-described fifth embodiment, and forms a shape such that middle portions of a circle in the up-down direction are recessed radially inward, as seen from the side which faces the projecting direction of the mounting projecting portion 530. Additionally, an engaging recessed groove 533 is formed at a proximal end of the mounting projecting portion body 537 over its entire periphery.

A bottom surface of the engaging recessed groove 533 is formed with planar abutted surfaces 546. The abutted surfaces 546 are surfaces on which abutting surfaces 549 (described later) abut when the handle member 540 is mounted on the mounting projecting portion 530, and are respectively formed in the positions of upper and lower portions (convexly curved portions 531) of the mounting projecting portion 530. In detail, each abutted surface 546 is a plane which forms a chord with respect to the circular sliding surface 534, i.e., a plane which extends in a direction orthogonal to the bottle axis L and along the vertical wall 121.

On the other hand, similarly to the mounting portion 541 in the above-described fifth embodiment, the mounting portion 541 of the handle member 540 is formed with a mounting hole 544 having a substantially circular cross-sectional shape. An inner peripheral surface of the mounting hole 544 is provided with a pair of abutting portions 545 and 545 which are arranged so as to sandwich the mounting projecting portion 530 from both sides in the direction of the bottle axis L in a state where the handle member 540 is mounted on the mounting projecting portion 530. The abutting portion 545 is formed with the planar abutting surface 549. The abutting surface 549 is a surface on which the abutted surface 546 abuts when the handle member 540 is mounted on the mounting projecting portion 530, and is formed at a tip face of the abutting portion 545 on the inside of the mounting hole 544. Additionally, the abutting surface 549 is a plane which forms a chord on the inner peripheral surface of the mounting hole 544, as seen from the side (side surface of the bottle) which faces the projecting direction of the mounting projecting portion 530.

Additionally, guide portions 547, which slide on the sliding surface 534 with the relative rotation of the handle member 540 and the bottle body 110 and guide the relative rotation, are provided so as to project from the surface (the surface which abuts on the vertical wall 121) of the mounting portion 541 on the radial inside of the bottle. Each guide portion 547 is an annular wall portion which is formed coaxially with the mounting hole 544, and extends along an imaginary circumference having a central axis O of the mounting projecting portion 530 as a center. That is, the guide portion 547 is formed with a fitting hole 547*a* which communicates with the mounting hole 544 and into which the circular pedestal portion 536 is slidably fitted, and an inner peripheral surface of the fitting hole 547*a* is brought into sliding contact with the sliding surface 534 (outer peripheral surface of the circular pedestal portion 536).

The bottle container 500 with a handle which is this embodiment is constructed by mounting this member 540 on the bottle body 110 as follows.

First, as shown in FIG. 20, in a way similar to the above-described fifth embodiment, the mounting projecting portion 530 is inserted into the mounting hole 544, thereby arranging the handle member 540 on the bottle body 110.

Next, the handle member 540 and the bottle body 110 are rotated relative to each other around the central axis O of the mounting projecting portion 530. At this time, the inner peripheral surface of the fitting hole 547*a* of the guide portion 547 slides on the sliding surface 534 of the mounting projecting portion 530. With the above relative rotation, the abutting portions 545 and 545 are accommodated inside the engaging recessed groove 533. Then, when the bottle body 110 and the handle member 540 have rotated relative to each other by 90°, the abutting surfaces 549 and 549 of the abutting portions 545 and 545 abut on the abutted surfaces 546, respectively, formed at the bottom surface of the engaging recessed groove 533, thereby regulating the relative rotation of the bottle body 110 and the handle member 540.

From the above, the handle member 540 is mounted on the bottle body 110.

According to the bottle container 500 with a handle having the aforementioned construction, the proximal end of the mounting projecting portion 530 is formed as the circular pedestal portion 536 whose outer peripheral surface becomes the sliding surface 534, and the circular pedestal portion 536 is slidably fitted into the fitting hole 547*a* of the annular guide portion 547. Accordingly, since the bottle body 110 and the handle member 540 are guided over the entire periphery when they are rotated relative to each other, the relative rotation is guided more reliably. Thereby, when the handle member 540 is mounted on the bottle body 110, the bottle body 110 and the handle member 540 can be smoothly rotated relative to each other, and the handle member 540 can be more easily mounted on the bottle body 110.

Additionally, since the guide portions 547 are provided so as to surround the circular pedestal portion 536, looseness of the handle member 540 after mounting is further suppressed. This allows the bottle body 110 and the handle member 540 to be more firmly fixed to each other.

Additionally, the abutting portion 545 is formed with the abutting surface 549 which forms a chord on the inner peripheral surface of the mounting hole 544, and the bottom surface of the engaging recessed groove 533 is formed with the planar abutted surface 546 on which the abutting surface 549 abuts when the handle member 540 has been mounted on the mounting projecting portion 530. Accordingly, the contact area between the abutting portion 545 and the bottom surface of the engaging recessed groove 533 becomes large, and looseness of the handle member 540 after mounting is further suppressed. This allows the bottle body 110 and the handle member 540 to be more firmly fixed to each other.

As described above, although the embodiments of the bottle container with a handle according to the invention have been described, the invention is not limited to the aforementioned embodiments and can be suitably changed without departing from the spirit or scope thereof.

For example, although the trunk portion of the bottle body forms a substantially rectangular tubular shape in the aforementioned embodiments, the invention is not limited thereto, and the trunk portion may form a cylindrical shape.

Moreover, the handle member may be integrally formed as in these embodiments, or may be molded such that a member including an integrally formed hinge portion is folded in two, and pasted together.

Moreover, the shape or construction of the handle member is not limited to these embodiments, and can be set suitably.

Here, the handle member needs to be constructed such that the mounting projecting portion provided so as to project from the bottle body is capable of inserting into the handle member, and the handle member is mounted on the bottle body by rotating the bottle body and the handle member relative to each other.

Although the mounting projecting portion 30 forms an octagonal cross-sectional shape in the first embodiment, the cross-sectional shape thereof just has to be a polygonal shape.

Moreover, although the annular locking portion 45 is provided in the first embodiment, the invention is not limited thereto, and locking portions may be provided intermittently in the peripheral direction of the mounting hole 44. Additionally, although the mounting portion 41 is provided with the abutting wall portion 46, the abutting wall portion 46 may not be provided.

Although the locking recessed portion 124 is provided only in the slope portion 123 of the bottle body 110 which is located below the mounting projecting portion 130 in the second embodiment, the invention is not limited thereto, and a locking recessed portion may be provided only above the mounting projecting portion 130 (for example, stepped portion 122), or locking recessed portions may be respectively provided above and below the mounting projecting portion 130.

In the fourth embodiment, the pair of abutting portions 345 are provided at upper and lower portions on the inner peripheral surface of the mounting hole 344, and the pair of retaining portions 346 are provided at right and left portions. However, the position and number of the abutting portions or retaining portions can also be changed in the invention. For example, a construction in which a plurality of abutting portions are provided in each of the upper and lower portions of the inner peripheral surface of the mounting hole 344 may be adopted. Otherwise, a construction in which a plurality of retaining portions are provided in each of both side portions of the inner peripheral surface of the mounting hole 344 may be adopted. Moreover, it is also possible to adopt a construction in which the retaining portions are provided in the upper and lower portions of the mounting hole 344, and the abutting portions are provided in both the side portions of the mounting hole 344.

Additionally, in the fourth embodiment, the abutting portions 345 are made to abut on the bottom surface of the engaging recessed groove 333 in a state where the handle member 340 is mounted on the mounting projecting portion 330. Instead of this, however, abutting portions may be made to abut on the outer peripheral surface of the mounting projecting portion 330.

Moreover, the engaging recessed groove 333 may not be formed at the entire periphery in the outer peripheral surface of the mounting projecting portion 330.

Furthermore, the method of mounting the handle member 340 on the bottle body 110 is not limited to the above embodiment. As mentioned above, at the beginning of mounting the handle member 340 on the bottle body 110, i.e., when the mounting projecting portion 330 is inserted into the mounting hole 344, the pair of retaining portions 346 may be housed inside the engaging recessed groove 333, and thereafter, the handle member 340 and the bottle body 110 are rotated relative to each other so as to mount the handle member 340 on the bottle body 110.

That is, while the mounting projecting portion 330 is inserted into the mounting hole 344, first, the distal end portion 346*b* of one retaining portion 346 of the pair of retaining portions 346 and 346 is inserted into the engaging recessed groove 333. By pushing in the retaining portion 346 toward the bottom surface of the engaging recessed groove 333, the tip face of the distal end portion 346*b* of the one retaining portion 346 is brought into pressure contact with the bottom surface of the engaging recessed groove 333, thereby compressing and deforming the proximal end portion 346*a* in an elastic state. Thereafter, by inserting the distal end portion 346*b* of the other retaining portion 346 into the engaging recessed groove 333 similarly, the mounting projecting portion 330 is inserted into the mounting hole 344, and the pair of retaining portions 346 and 346 is housed inside the engaging recessed groove 333. Then, the proximal end portion 346*a* of the one retaining portion 346 is restored and deformed to original state by releasing the aforementioned push-in. Then, similarly to the above embodiment, the handle member 340 and the bottle body 110 are rotated relative to each other, and the handle member 340 is mounted on the bottle body 110.

Figure 21:
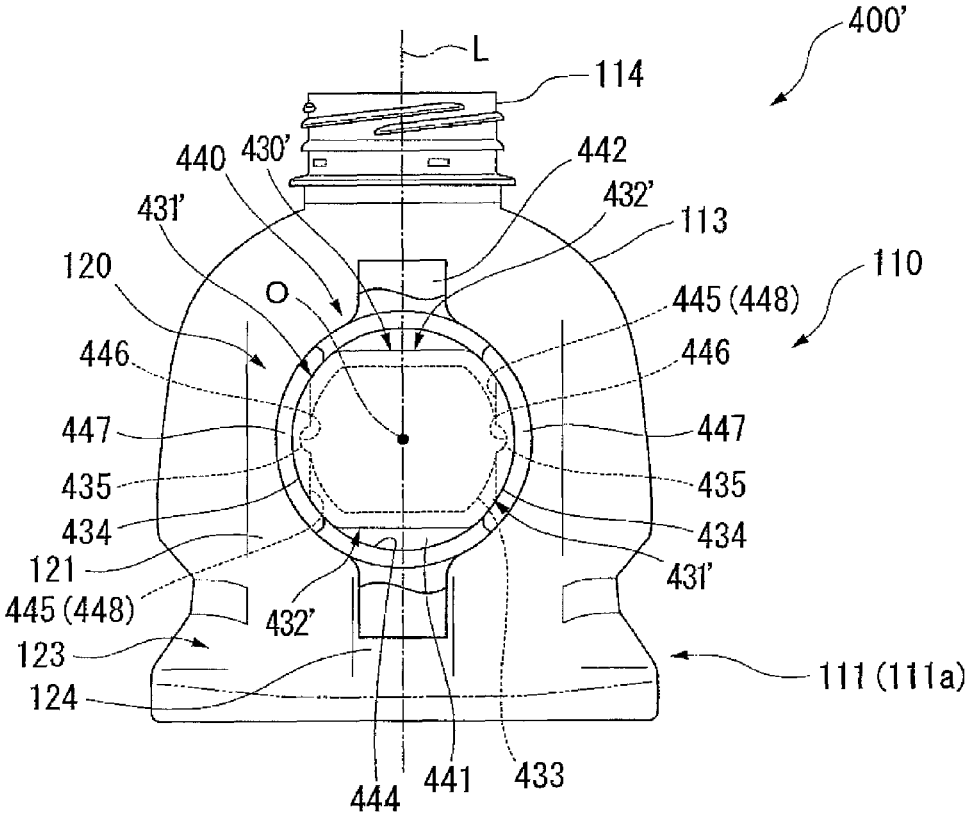
FIG. 21 is a side view of a bottle container with a handle which is another embodiment of the invention.
Figure 22:
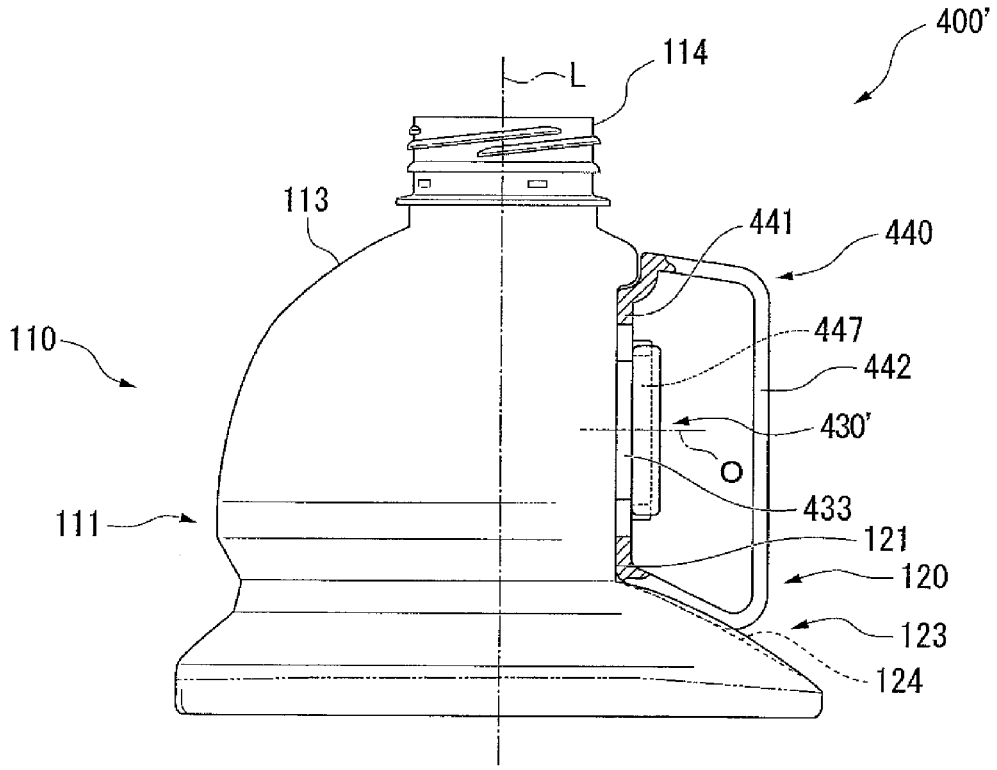
FIG. 22 is a side view of a bottle body which constitutes the bottle container with a handle shown in FIG. 21.
Figure 23:
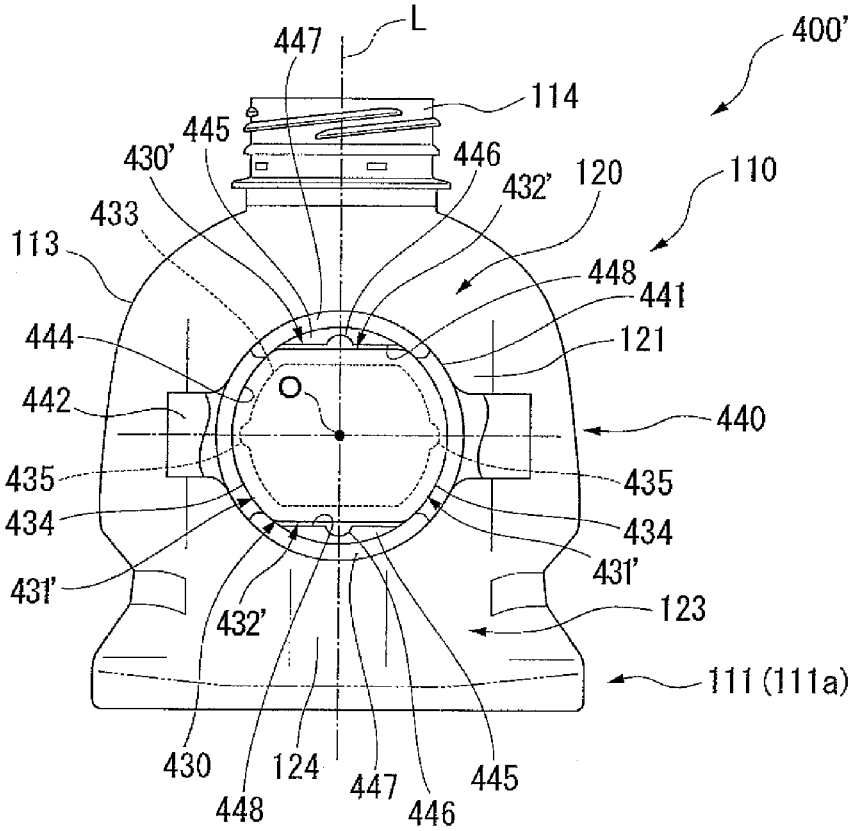
FIG. 23 is a front view when a mounting projecting portion of the bottle body shown in FIG. 22 is seen from the front.

In the fifth embodiment, the pair of abutting portions 445 and 445 is disposed so as to sandwich the bottom surface of the engaging recessed groove 433 from both sides in the up-down direction (the direction of the bottle axis L) in a state where the handle member 440 is mounted on the mounting projecting portion 430. However, in the invention, as shown in FIGS. 21 to 23, the pair of abutting portions 445 and 445 can also be disposed so as to sandwich the bottom surface of the engaging recessed groove 433 from both sides in the right-left direction in a state where the handle member 440 is mounted on the mounting projecting portion 430. In detail, on the side of the bottle body 110, an oval mounting projecting portion 430' which is long in the right-left direction is provided so as to project. In the mounting projecting portion 430', side surface portions on both right and left sides of the mounting projecting portion 430' are respectively formed as convexly curved portions 431' which are convex in a circular arc shape toward an up-down direction, and upper and lower portions of the mounting projecting portion 430' are respectively formed as planar portions 432' which form a chord on the outer peripheral surface of the mounting projecting portion 430', as seen from the side which faces the projecting direction of the mounting projecting portion 430'.

Additionally, the projecting portions 435 are respectively provided in the positions of side surface portions on both right and left sides of the mounting projecting portion 430, on the bottom surface of the engaging recessed groove 433. Additionally, the circular-arc sliding surfaces 434 are respectively formed at the outer peripheral surfaces of the side surface portions in both right and left sides of the mounting projecting portion 430. On the other hand, as for the handle member 440, the abutting portions 445 and the guide portions 447 are respectively arranged so as to sandwich the mounting projecting portion 430 from both sides in the right-left direction.

In addition, in the sixth embodiment, the pair of abutting portions 145 and 145 may be disposed so as to sandwich the bottom surface of the engaging recessed groove 133 from both sides in the right-left direction in a state where the handle member 540 is mounted on the mounting projecting portion 530.

Additionally, in the fifth and sixth embodiments, the pair of upper and lower abutting portions 445 or 545 are provided on the inner peripheral surface of the mounting hole 444 or 544. However, the position and number of the abutting portions can be changed in the invention. For example, a construction in which a plurality of abutting portions are provided in each of the upper and lower portions on the inner peripheral surface of the mounting hole 444 or 544 may be adopted.

Additionally, in the fifth embodiment, the pair of upper and lower guide portions 447 is provided. However, the position and number of the guide portions can be changed in the invention. For example, a construction in which a plurality of guide portions are provided in each of the upper and lower portions of the mounting portion 441 may be adopted, or a construction in which an annular guide portion extending over the entire periphery is provided may be adopted.

Moreover, the engaging recessed groove 433 may not be formed at the entire periphery in the outer peripheral surface of the mounting projecting portion 430.

Additionally, a locked portion made up of a recessed portion or a projecting portion may be provided in an arbitrary position of the bottle body, and a locking portion fitting to the locked portion may be provided so as to project or be recessed from the surface of the handle member which faces the bottle body.

In addition, in the fifth embodiment, a construction in which the locking recessed portion 124 is formed in the stepped portion 122, and the portion of the handle portion 442 extending from the upper end of the mounting portion 441 is accommodated in the locking recessed portion 124 may be adopted.

In addition, it is possible to suitably substitute the components in the aforementioned components with well-known components without departing from the spirit or scope of the invention, and the aforementioned embodiments and/or modifications may be suitably combined with each other. For example, in the sixth embodiment, the recessed portion 446 in the fifth embodiment may be formed in the abutting surface 549 of the abutting portion 545, and the projecting portion 435 in the fifth embodiment may be provided so as to project from the abutted surface 546 of the bottom surface of the engaging recessed groove 533.

INDUSTRIAL APPLICABILITY

According to the invention, a bottle container with a handle in which the bottle body and the handle member are firmly fixed to each other to prevent the bottle body from falling off at the time of handling can be provided. Additionally, a bottle container with a handle capable of smoothly rotating the handle member and the bottle body relative to each other when the handle member is mounted on the bottle body, and capable of suppressing looseness of the handle member after mounting can be provided.

What is claimed is:

1. A bottle container with a handle comprising:

a bottle body provided with a mounting projecting portion so as to project therefrom; and a handle member mounted on the mounting projecting portion, wherein the handle member has a mounting portion formed with a mounting hole which allows the mounting projecting portion to be inserted thereinto, and a handle portion connected to the mounting portion, and is mounted on the bottle body by inserting the mounting projecting portion into the mounting hole, and then rotating the mounting portion around a central axis of the mounting projecting portion relative to the bottle body, wherein an outer peripheral surface of the mounting projecting portion is formed with an engaging recessed groove which extends in a peripheral direction of the mounting projecting portion, and a sliding surface which extends along a circumference having a central axis of the mounting projecting portion as a center, wherein the inner peripheral surface of the mounting hole is provided with an abutting portion which is accommodated inside the engaging recessed groove, and abuts on a bottom surface of the engaging recessed groove, and wherein the mounting portion is provided with a guide portion which slides on the sliding surface with the relative rotation of the handle member and the bottle body, and guides the relative rotation.

2. The bottle container with a handle according to claim 1, wherein the abutting portion is disposed so as to sandwich the bottom surface of the engaging recessed groove from both sides in the direction of a bottle axis in a state where the handle member has been mounted on the mounting projecting portion.

3. The bottle container with a handle according to claim 1, wherein the guide portion has a circular-arc surface which extends along the sliding surface, and is disposed so as to sandwich the mounting projecting portion in its radial direction.

4. The bottle container with a handle according to claim 1, wherein a proximal end portion of the mounting projecting portion becomes a circular pedestal portion whose outer peripheral surface is formed as the sliding surface, and the guide portion has a fitting hole into which the circular pedestal portion is slidably fitted.

5. The bottle container with a handle according to claim 1, wherein the abutting portion is formed with a recessed portion which is recessed radially outward of the mounting hole, and the bottom surface of the engaging recessed groove is formed with a projecting portion which projects radially outward of the mounting projecting portion, and is engaged with the recessed portion when the handle member has been mounted on the mounting projecting portion.

6. The bottle container with a handle according to claim 1, wherein the abutting portion is formed with an abutting surface which forms a chord on the inner peripheral surface of the mounting hole seen from a side surface of the bottle, and the bottom surface of the engaging recessed groove is formed with a planar abutted surface on which the abutting surface abuts when the handle member is mounted on the mounting projecting portion.

* * * * *